US008647017B2

(12) United States Patent
Foote

(10) Patent No.: US 8,647,017 B2
(45) Date of Patent: Feb. 11, 2014

(54) GRAVITY BASE STRUCTURE

(75) Inventor: Bernard Foote, Haslemere (GB)

(73) Assignee: Ausenco Canada Inc., Vancouver, B.C. (CA)

( * ) Notice: Subject to any disclaimer, the term of this patent is extended or adjusted under 35 U.S.C. 154(b) by 0 days.

(21) Appl. No.: 13/569,930

(22) Filed: Aug. 8, 2012

(65) Prior Publication Data

US 2013/0034391 A1 Feb. 7, 2013

Related U.S. Application Data

(63) Continuation-in-part of application No. 13/368,210, filed on Feb. 7, 2012.

(60) Provisional application No. 61/441,245, filed on Feb. 9, 2011.

(51) Int. Cl.
*B63B 35/40* (2006.01)

(52) U.S. Cl.
USPC ..... 405/208; 405/207; 405/205; 405/195.1; 405/224; 405/226

(58) Field of Classification Search
USPC ..... 405/195.1, 203–206, 208, 226, 227
See application file for complete search history.

(56) References Cited

U.S. PATENT DOCUMENTS

| | | | | |
|---|---|---|---|---|
| 2,581,098 | A * | 1/1952 | Guenzel | 405/204 |
| 2,938,352 | A * | 5/1960 | Knapp et al. | 405/207 |
| 3,081,600 | A * | 3/1963 | Davidon | 405/208 |
| 3,729,940 | A * | 5/1973 | Koehler | 405/205 |
| 3,911,687 | A * | 10/1975 | Mo | 405/225 |
| 3,998,061 | A * | 12/1976 | Rederon et al. | 405/205 |
| 4,479,742 | A | 10/1984 | Bruce | |
| 4,484,841 | A * | 11/1984 | Einstabland | 405/212 |
| 4,639,167 | A | 1/1987 | Petty et al. | |
| 4,695,197 | A * | 9/1987 | Watt et al. | 405/224 |
| 4,696,601 | A * | 9/1987 | Davenport | 405/202 |
| 4,808,036 | A | 2/1989 | Bhalaik et al. | |
| 5,316,413 | A | 5/1994 | Sisodiya et al. | |
| 5,383,748 | A | 1/1995 | Waddell | |

(Continued)

FOREIGN PATENT DOCUMENTS

| | | |
|---|---|---|
| RU | 2235183 C1 | 8/2004 |
| SU | 1553016 A3 | 3/1990 |

OTHER PUBLICATIONS

"Disposal of concrete facilities," *Norwegian Petroleum Directorate,* ISBN 978-82-7257-067-4, 59 pages, Mar. 21, 2012.

(Continued)

*Primary Examiner* — Thomas B Will
*Assistant Examiner* — Jessica H Lutz
(74) *Attorney, Agent, or Firm* — Klarquist Sparkman, LLP

(57) ABSTRACT

Embodiments of gravity base structures are disclosed that comprise first and second elongated base sections separated by an open region and configured to support the on-bottom weight of the structure on a seabed, and an upper section positioned above the open region and configured to extend at least partially above the water surface to support topside structures. Some embodiments further comprise first and second inclined sections coupling the base sections to the upper section. Some embodiments comprise a skirt structure below the base sections for facilitating engagement with the seabed. Some embodiments comprise selectively fillable internal fluid chambers to facilitate raising and lowering the structure in a sea and relocating the structure.

20 Claims, 14 Drawing Sheets

(56) References Cited

U.S. PATENT DOCUMENTS

| | | | | |
|---|---|---|---|---|
| 5,470,179 | A * | 11/1995 | Maciel | 405/224 |
| 5,551,802 | A * | 9/1996 | Wybro | 405/223.1 |
| 5,613,808 | A | 3/1997 | Fitzpatrick | |
| 5,775,846 | A | 7/1998 | Blandford et al. | |
| 5,881,815 | A * | 3/1999 | Horton, III | 166/350 |
| 6,203,248 | B1 * | 3/2001 | Childers et al. | 405/227 |
| 6,447,208 | B1 | 9/2002 | Huang et al. | |
| 6,761,124 | B1 | 7/2004 | Srinivasan | |
| 7,140,317 | B2 | 11/2006 | Wybro et al. | |
| 2004/0131427 | A1 * | 7/2004 | Wybro et al. | 405/205 |
| 2006/0275080 | A1 | 12/2006 | Li et al. | |
| 2009/0035069 | A1 | 2/2009 | Krehbiel et al. | |
| 2010/0221069 | A1 | 9/2010 | Brinkmann et al. | |

OTHER PUBLICATIONS

Russian Office Action dated Jun. 24, 2013, issued by the Russian Intellectual Property Federal Service in corresponding Russian Patent Application No. 2012104216/03(006350), filed Aug. 2, 2012. English language translation of Russian Office Action of Jun. 24, 2013.

* cited by examiner

GRAVITY BASE STRUCTURE

CROSS-REFERENCE TO RELATED APPLICATIONS

This application is a continuation-in-part of U.S. patent application Ser. No. 13/368,210, filed on Feb. 7, 2012, which claims the benefit of U.S. Provisional Patent Application No. 61/441,245, filed Feb. 9, 2011, both of which applications are incorporated herein by reference.

FIELD

This disclosure is related to gravity base structures, such as for supporting hydrocarbon drilling and extraction facilities in deep arctic seas.

BACKGROUND

Deepwater gravity base structure (GBS) concepts for regions experiencing significant sea ice have traditionally been based on large monolithic steel or concrete substructures supporting offshore hydrocarbon drilling or production facilities. In deeper waters, the size, weight and cost of these structures pose major challenges in terms of design, construction, and installation. Traditional GBS designs generally rely on a monolithic caisson, with or without discrete vertical legs, filled largely with sea water and/or solid ballast to resist horizontal loads from ice and wave interaction. The caisson gross volume and minimum required on bottom weight increase rapidly with water depth and horizontal load. This can lead to difficulty in satisfying the foundation design requirements, especially in weaker cohesive soils.

SUMMARY

Embodiments of open gravity base structures for use in deep arctic waters are disclosed that comprise wide-set first and second elongated base sections separated by an open region and configured to support the on-bottom weight of the structure on the seabed. An upper caisson section can be positioned above the open region and configured to extend at least partially above the water surface to support topside structures. The structure can further comprise first and second inclined strut sections coupling the wide set base sections to the upper sections.

In some embodiments, the structure can comprise internal fluid storage chambers that can be selectively filled partially or entirely with fluid and emptied partially or entirely of fluid to lower and raise the structure in the sea. A skirt structure, which can comprise a plurality of downwardly open compartments, can be attached to the base sections to facilitate positioning the structure on a seabed. The structure can further comprise a piping system configured to expel or extract fluid from the skirt cell regions below the base sections to further facilitate placement of the structure on the seabed and lift-off of the structure from the seabed. The structure can be repositioned to different seabed locations by floating the structure up off of the seabed at one location, towing the structure in a floating configuration to a second location, and then sinking the structure to the seabed at the second location. The depth of floating the structure can be adjusted by adjusting the fluid level in the chambers to stabilize the structure when being moved and to accommodate adverse environmental conditions such as waves, wind and ice.

The foregoing and other objects, features, and advantages of embodiments disclosed herein will become more apparent from the following detailed description, which proceeds with reference to the accompanying figures.

DETAILED DESCRIPTION

Described here are embodiments of gravity base structures (GBS) that significantly reduce the substructure weight required for a given water depth while offering considerable advantages in constructability, transportation, installation, relocation, and removal. The disclosed embodiments can be used to support drilling or production facilities in water depths of up to 200 meters or more. Some embodiments can support topside facilities with large installation weights, such as from about 30,000 tonnes to about 90,000 tonnes, or more. Some embodiments have the capability to withstand ice, water, and soil conditions typical of the arctic and sub-arctic seas, such as in the Beaufort Sea and the Kara Sea.

The embodiments disclosed herein can reduce the traditional conflict between bearing load, buoyancy, and footprint area by supporting the topsides on widely separated base sections and support struts. These large base sections and support struts can provide manufacturing and construction efficiencies due to modular designs. Components can also be symmetric to increase manufacturing efficiency.

Figure 1:
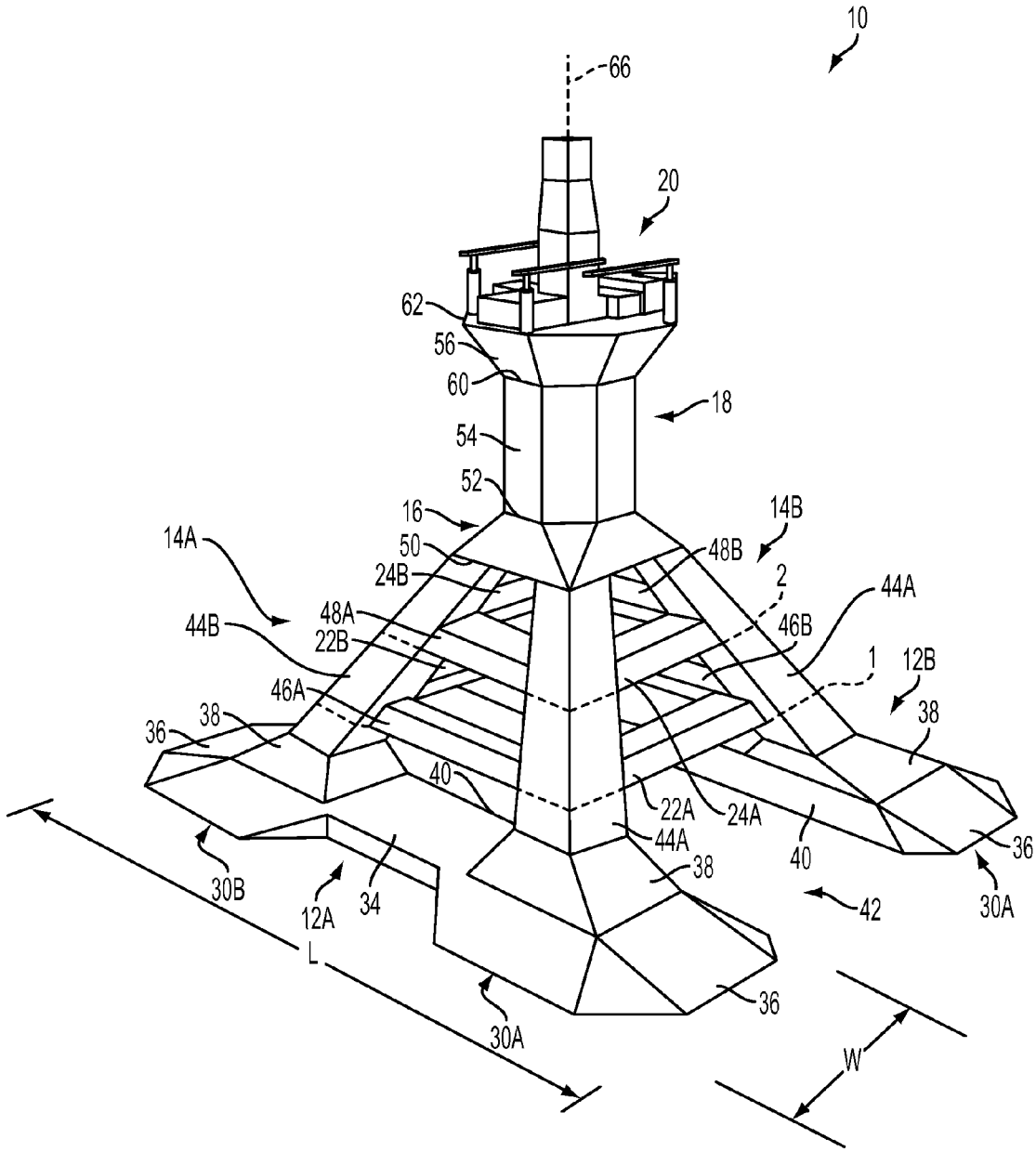
FIG. 1 illustrates an exemplary embodiment of a gravity base structure with two separated base sections.

FIGS. 1 and 2 show an exemplary embodiment of a GBS 10 comprising a first base section 12A and a second base section 12B, a first inclined section 14A, a second inclined section 14B, a transition section 16, and an upper section 18, and can support a topside section 20. Some embodiments of the GBS 10 can further comprise one or more cross ties extending between the inclined sections 14, such as spaced apart cross ties 22A and 22B and spaced apart cross ties 24A and 24B.

Each of the base sections 12 can be configured to be supported on a seabed and can support the rest of the GBS 10. The base sections 12 can each comprise a first foot portion 30A, a second foot portion 30B, and an intermediate portion 34 extending between the first and second foot portions. The base sections 12 can be elongated in the direction between the first and second foot portions 30A, 30B. The foot portions 30 can have a large bottom surface area and can taper in horizontal cross-sectional area moving upward from a base surface across a sloped upper surface. The foot portions 30A, 30B can each comprise a chamfered outer portion 36 that has a gently inclined upper surface, and can comprise an upwardly projecting portion 38 that can have side surfaces that are more steeply inclined than the surface 36. The foot portions 30A, 30B can comprise a plurality of flat, polygonal surfaces, although some embodiments can comprise curved surfaces or other non-flat and/or non-polygonal surfaces.

Figure 2A:
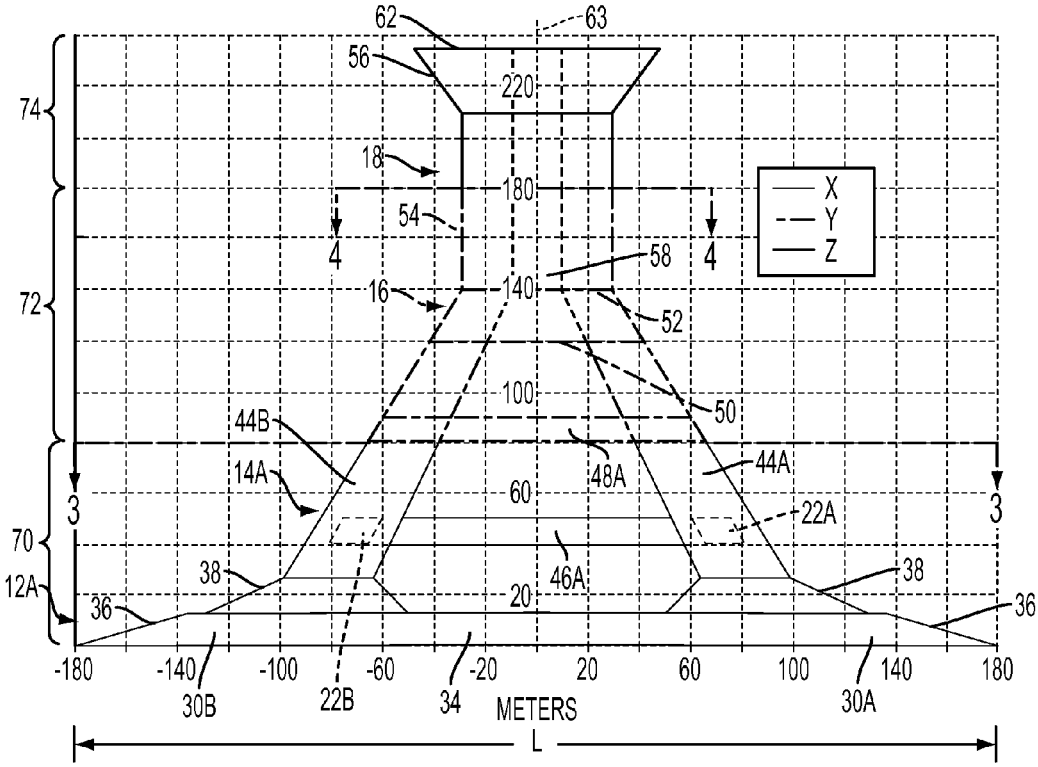
FIG. 2A is a side profile view of the embodiment of FIG. 1.
Figure 2B:
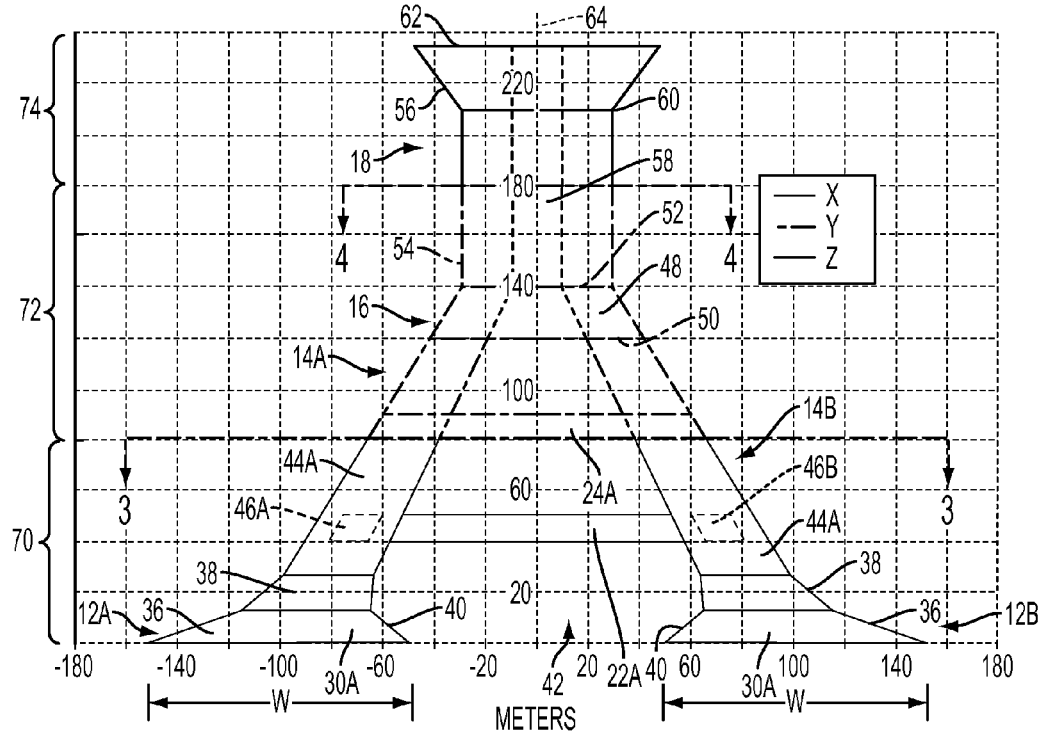
FIG. 2B is a front end profile view of the embodiment of FIG. 1.

Each of the base sections 12 can have an overall longitudinal length L and an overall width W, as shown in FIG. 1. Each foot portion 30 can have a maximum width of W while the intermediate portion 34 can have a reduced width, creating a neck or intermediate section of reduced width between the two foot portions 30A, 30B. Each of the base sections 12 can have an outer sidewall surface and can have a generally straight inner sidewall surface 40 that extends the full length of the base section 12 across both of the foot portions 30A, 30B and the intermediate portion 34 along the length direction L. Each base section 12 can be generally symmetrical about a first vertical plane 63 (see FIG. 3) cutting through the intermediate portion 34 midway between the foot portions 30. In addition, the base section 12A can be generally symmetrical with the base portion 12B about a second vertical plane 64 (see FIG. 3) extending in the length direction L half way between the two base sections 12. These first and second vertical planes 63, 64 can each generally bisect the entire GBS 10 into respective symmetrical halves on either side of each of the planes, as shown in FIGS. 2A and 2B.

The two base portions 12A and 12B can be widely separated by an open region 42 between the inner sides 40 of the two base sections. The open region 42 can extend the entire length L of the base sections. In embodiments without the cross-ties 22 and 24, the open region can extend upward to the transition section 16 and separate the two inclined sections as well. An embodiment has an "open region" between the two base sections 12A, 12B when the entire region directly between the two base sections 12A, 12B is obstructed by less than 10% of structural components. In some embodiments, the two base sections 12A and 12B can be "completely separated" by the open region 42, meaning that there are no structural components extending directly between the two base sections 12.

Figure 3:
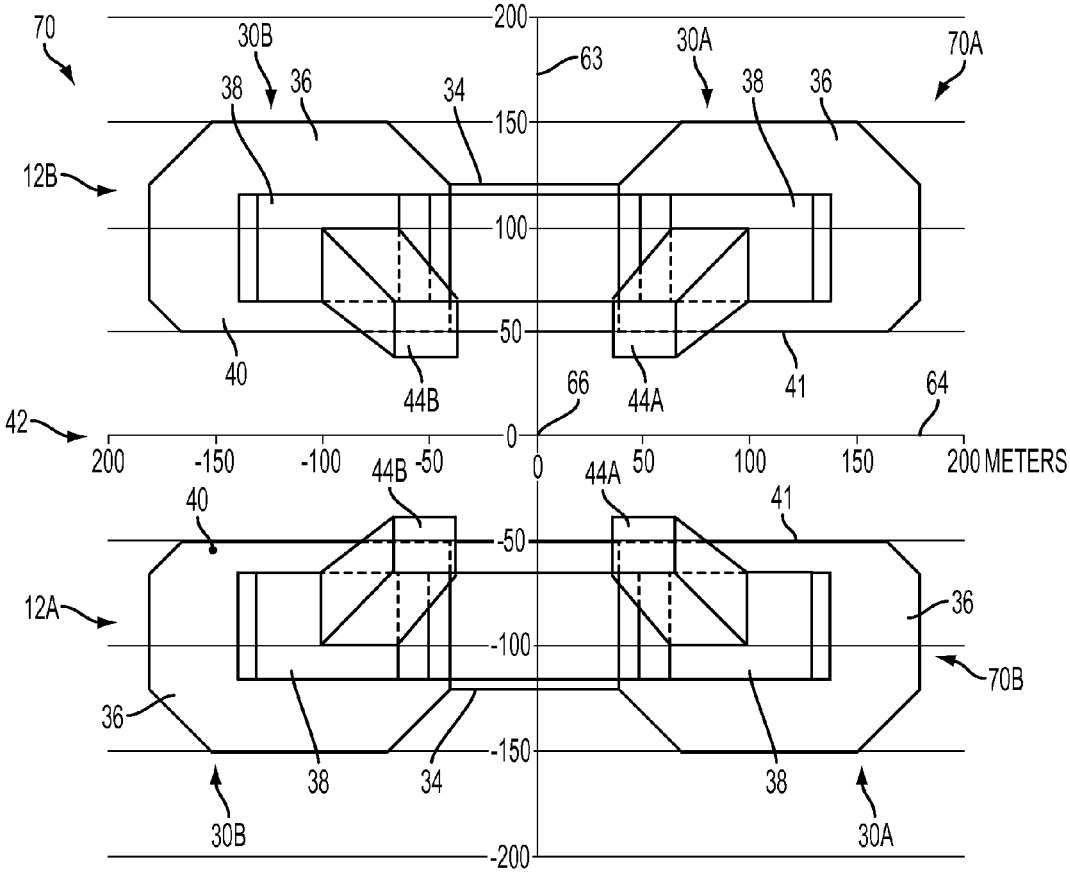
FIG. 3 is a top plan view of first and second spaced apart base units of an exemplary gravity base structure in the direction of arrows 3-3 of FIGS. 2A and 2B.

Each base section 12A, 12B can comprise a footprint area defined by the perimeter of the bottom surface of the base section that is configured to contact the underlying seabed. Exemplary footprint areas are shown in FIG. 3 by the bolded outer perimeter of the base section 12. The open region 42 between the footprints of the base sections 12 can have an area that is greater than either of the footprint areas, or more than 50% of the total area of the two footprints. In other embodiments, open region 42 between the footprints of the base sections 12 can have an area that is at least 25% of the total area of the two footprints. In some embodiments, each of the footprints can have an area that is greater than the maximum horizontal cross-section area of the upright annular section, or caisson section, 18.

Each of the inclined sections 14A, 14B can extend upwardly from the upper portions 38 of the foot portions 30A, 30B of their associated base sections 12A, 12B to the transition section 16. It should be noted that a stub portion of a corner structure of each of the sections 14A, 14B can be included in the associated base section. The inner portions 14A, 14B can be inclined such that they lean toward one another. The distance between the two inclined portions 14A, 14B can decrease moving from the base sections 12 toward the transition section 16, such that the two inclined portions can be more readily connected together at the transition portion 16. The inclined nature of the inclined sections is best seen in the end view of FIG. 2B. Thus, the side portions 14A, 14B can converge, or at least portions thereof can converge, moving away from their associated base section 12. Desirably they continuously converge moving upwardly. However, they can less desirably have sections that converge with intervening non-converging portions.

Each inclined section 14A, 14B can comprise a first and second strut 44A, 44B and one or more horizontal cross members, such as 46A and 48A for inclined section 14A and 46B and 48B for inclined section 14B, which can be parallel to and spread apart one above the other. One strut 44A is coupled to one foot portion 30A of each base section 12 and the other strut 44B is coupled to the other foot portion 30B of each base section. The struts 44A and 44B of the respective inclined section 14A can converge, in whole or in part toward one another. The struts of section 14B can be arranged in the same manner. Thus, the struts of one section 14A can slant toward one another and toward the struts of the other inclined section 14B and these struts of section 14B can slant toward one another and toward the struts of section 14A. Each strut 44 can have a generally square horizontal cross section that decreases in area with elevation. Other cross sectional configurations can be employed. The four struts 44 can have the same degree of slant and can be generally symmetrical about a vertical central axis 66 of the GBS 10 defined by the intersection of the planes of symmetry 63 and 64. The struts can continuously converge over their lengths. Alternatively, the struts can have one or more converging sections.

Each inclined section 14A, 14B can comprise zero, one, two, or more horizontal cross members connecting the struts 44A and 44B together. The embodiment of FIG. 1 comprises a longer lower cross member 46A and a shorter upper cross member 48A interconnecting the struts 44A and 44B of the first inclined section 14A and a longer lower cross member 46B and a shorter upper cross member 48B interconnecting the struts 44A and 44B of the second inclined section 14B. The cross members 46, 48 can, for example, have a generally quadrilateral vertical cross-section with horizontal upper and lower surfaces and inclined side surfaces.

In embodiments designed for deeper waters, the GBS 10 can comprise cross ties 22 and/or 24 extending between and coupling the two inclined sections 14A and 14B. One set of cross ties 22A and 24A can interconnect the two struts 44A and another set of cross ties 22B and 24B can interconnect the two struts 44B. The cross ties 22, 24 can be similar in shape and elevation to the cross members 46, 48 when present.

The upper ends of the struts 14 can be connected together by the transition section 16. The transition section 16 can be at least partially frustoconical, have the general shape of a frustum, or have another shape. The transition section 16 can have a broader lower perimeter 50 having a first cross sectional area and can taper to a narrower upper perimeter 52 having a second cross section less than the first cross sectional area. The transition section 16 can comprise an axially extending open inner or central region 48 (FIG. 2). In the embodiment of FIG. 1, the transition section 16 has a square lower perimeter 50 and an octagonal upper perimeter 52, with polygonal side surfaces. In other embodiments, the transition section 16 can have circular upper and lower perimeters and a frustoconical side surface, or have other configurations.

The upper section 18 of the GBS 10 can extend upwardly from the upper perimeter, or top, 52 of the transition section 16. The upper section 18 can comprise an upright annular portion 54 and a flared or enlarged top portion 56. The upper section 18 can have an open axially extending inner or central region 58 (FIG. 2). Central region 58 can be vertically oriented and can communicate with the open region 48 within the transition section 16. The upper section 18 can have a polygonal cross-section, as shown FIG. 1, a circular cross-section, or any other suitable shape. The flared portion 56 can have a narrower lower perimeter 60 with a smaller cross-sectional area than the upper surface 62 of the flared portion 56. The lower perimeter 60 is located at the intersection with the top of the annular upright portion 54. The flared portion 56 can increase in cross-section area toward a broad upper surface 62, which can support the topside structures 20.

The GBS can be sized such that, when supported on a seabed, the upright annular portion 54 of the upper section 18 is partially under water and partially above water. The upright annular portion 54 can have a smaller horizontal width relative to other portions the GBS 10 such that it receives less lateral force from waves and ice loads, which are generally concentrated near the upper surface of the sea. Various embodiments of the GBS 10 can be configured to be used in sea depths greater than 60 meters, such as depths ranging from about 60 meters to about 200 meters, though the GBS 10 can be configured to be used in other depths of water as well.

Figure 4:
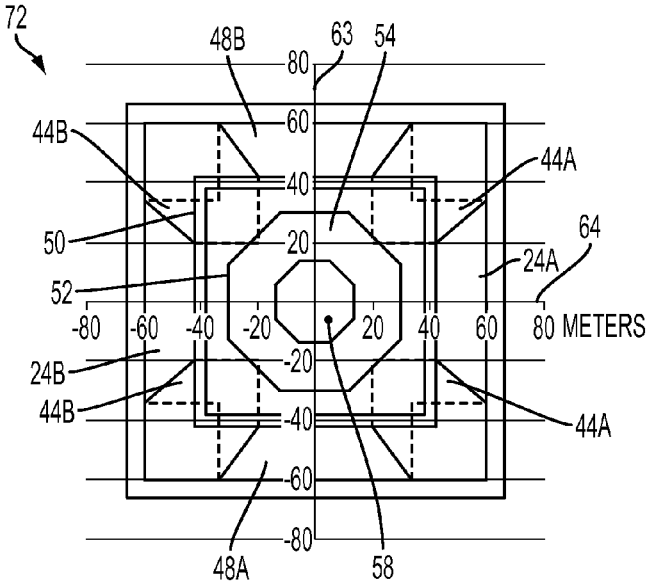
FIG. 4 is a top plan view of a middle portion of an exemplary gravity base structure in the direction of arrows 4-4 of FIGS. 2A and 2B.

The dimensions shown in FIGS. 2-4 are merely exemplary and do not limit the disclosure in any way. These dimensions illustrate one exemplary embodiment, and other embodiments can have different dimensions.

FIGS. 2A and 2B illustrate one exemplary division of the GBS 10 into three assembly units 70, 72, and 74. A base unit 70 (shown in regular solid lines X) can comprise the two base sections 12A, 12B and lower portions of the two inclined sections 14A, 14B (e.g., lower portions of the struts 44A, 44B, lower cross members 46, and/or lower cross ties 22). In some embodiments, the lower cross members 46A, 46B can be included in the base unit 70. In addition, the base unit 70 can alternatively also comprise the lower cross ties 22A, 22B. In embodiments where the base unit 70 does not include lower cross ties 22A, 22B (such as for shallower waters), the base unit 70 can comprise two separate assembly base units 70A and 70B (as shown in FIG. 3). The middle unit 72 (shown in bolded dashed lines Y in FIGS. 2A and 2B and also shown in FIG. 4) can comprise upper portions of the inclined sections 14, the transition section 16, a lower portion of the upper section 18, and optionally the upper cross ties 24A, 24B. The top unit 74 (shown in solid bold lines Z) can comprise an upper portion of the upper section 18 and optionally the topside structures 20.

Each of the assembly units 70, 72, 74 can be constructed individually in a large dock. During assembly of the GBS, the base unit 70 can be positioned first floating partially submerged in a sea, then the middle unit 72 can be positioned over and coupled to the base unit 70, then the combined base unit 70 and middle unit 72 can be lowered in the water, then the top unit 74 can be positioned over and coupled to the middle unit 72. In some embodiments, the lower cross ties 22 can be coupled to the base unit 70 and the upper cross ties 24 can be coupled to the middle unit 72 before the top unit 74 is attached. In other embodiments, the GBS unit 10 can be divided into various other assembly units and/or sub-units and can be assembled in various other manners.

FIG. 3 shows a top plan view of the base units 70A, 70B of the embodiment of FIG. 2 without cross members 46 or cross ties 22. This view illustrates the open region 42 between the inner side surfaces 40 of the two base sections 12A and 12B. The inner most edges 41 of the inner side surfaces 40 can be parallel. This view also illustrates an exemplary footprint of the base sections 12 on the seabed, with the narrow intermediate portions 34 and the broader foot portion 30. The base units 70A, 70B can be symmetrical with each other about a vertical plane 64, while each can be symmetrical about a vertical plane 63. This view also shows lower portions of the four struts 44 slanting toward a central axis 66 of the structure, which is desirably vertical.

FIG. 4 shows a top plan view of the middle unit 72 of the embodiment of FIG. 2. This view illustrates the exemplary square cross sectional peripheral shape created by the four struts 44, the upper cross members 48A, 48B and the upper cross ties 24A, 24B at the bottom of the middle unit 72. This view also illustrates the octagonal cross-section of the exemplary upright annular portion 54. The middle portion 72 can be symmetrical about the vertical planes 63 and 64. In some embodiments, the middle portion 72 can also be symmetrical about two diagonal vertical planes (not shown) at 45° to the planes 63 and 64.

Figure 5:
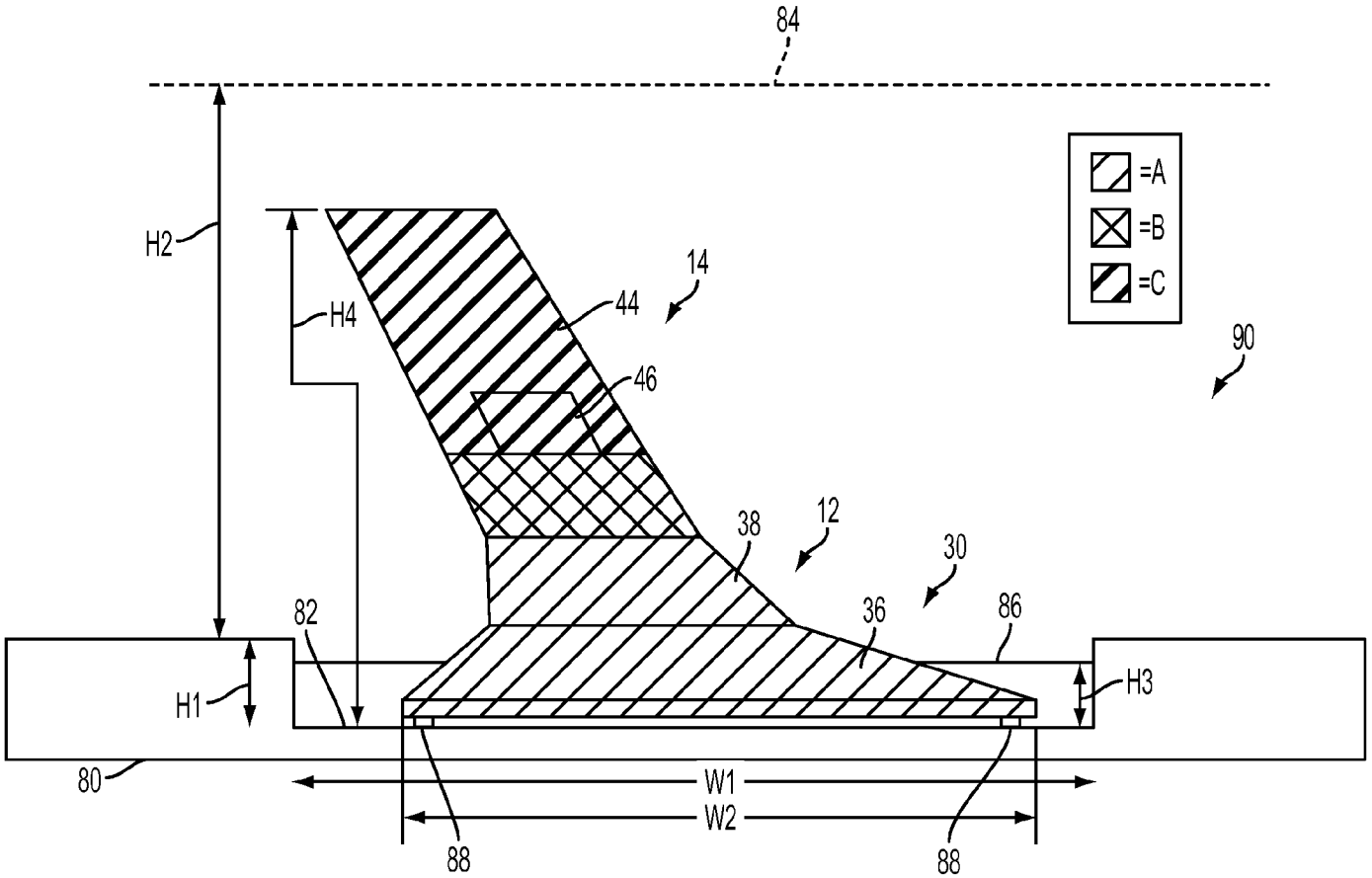
FIG. 5 is an end profile view of a base unit of an exemplary gravity base structure in a dry dock environment.
Figure 6:
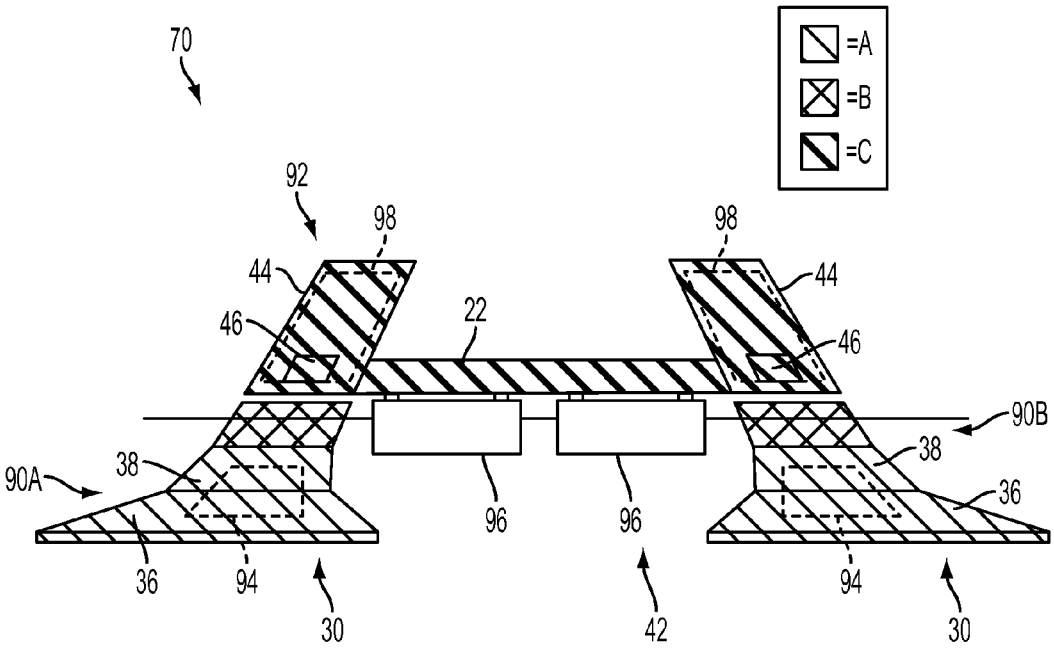
FIG. 6 is an end profile view of an at-sea assembly of a portion of an exemplary gravity base structure comprising first and second base portions and a first upper section in position for assembly.

FIGS. 5 and 6 illustrate one exemplary construction approach of the base unit 70 shown in FIGS. 2A and 2B. In this approach, the base unit 70 is assembled from two base portions 90A and 90B and a third portion 92 that connects the base portions 90A, 90B. As shown in FIG. 5, in some embodiments, the two base portions 90 can be constructed individually in a dry dock 80. FIG. 5 shows a cross-sectional end view of one of the base portions 90 as constructed in dry dock 80. In some embodiments, the base portions 90 are extremely large and require very large dry docks. One very large dry dock 80 is illustrated. The dry dock 80 can comprise a floor 82 with a width W1 of about 131 meters and a lift 84, such as a goliath lift, which can have a maximum lifting height H2 of about 91 meters above the floor 82. The dock 80 can have a depth H1 of about 14.5 meters, which can be partially filled with water or other liquids 86, such as to a height H3 of about 10 meters, in order to help support and construct the base portions 90. The bottom surfaces of the base portions 90 can be spaced above the floor 82, such as via blocks 88, about 1.8 meters. Using such a large dry dock 80, each entire base portion 90 can be constructed at one time, and then moved as a single unit out of the dry dock for assembly to the base portion and the third portion 92 at sea.

In some embodiments, the base portions 90 can include the parts marked in FIG. 5 as A and B, and the part marked as C can be constructed with the third portion 92 (as shown in FIG. 6). Base portions comprising only parts A and B can comprise the portion of FIG. 1 shown below the dashed lines 1. In other embodiments, given a large enough dry dock, all three parts A, B and C shown in FIG. 5 can be constructed at once with the base portion 90, which can rise to a height H4 of about 85 meters above the floor 82. Such a base portion with parts A, B, and C can comprise the portion of FIG. 1 shown below the dashed lines 2. Two base portions comprising parts A, B and C can then be coupled together with the lower cross ties 22 at sea to form the base unit 70.

Importantly, the base portions 90 have a base length L (see FIG. 1) that is much greater than its base width (W2 shown in FIG. 5), and the dry dock 80 also desirably has sufficient length. The open region 42 between the two base sections 12A, 12B allows for the separate construction of each of the two discrete base portions 90 in their entirety in a single dry dock, one after another, such that they can later be assembled with other components at sea to form the GBS 10. This constructability would not be possible for a GBS having a base structure that exceeds the width of the dry dock.

As shown in FIG. 6, in some embodiments, the base unit 70 can be constructed in three parts. The two base portions 90A and 90B can comprise the portions of the GBS below the lower cross members 46 and the lower cross ties 22, which includes the parts marked as A and B in FIGS. 5 and 6. The third portion 92 can comprise the lower cross members 46A, 46B, the lower cross ties 22A, 22B, and intermediate portions of the four struts 44 up to the bottom of the upper cross members 48A, 48B and upper cross ties 24A, 24B. To assemble the three portions 90A, 90B and 92, the portions 90A and 90B can first be positioned in the floating arrangement shown in FIG. 6 at sea. To reduce the buoyancy of the portions 90A and 90B, enclosed internal regions in the portions 90A and 90B, such as those shown as 94 in FIG. 6, can be flooded with seawater, causing them to float lower in the water. Once they are floating at a desired level and proper lateral relation to one another, the third portion 92 can be transported over the top of them. As shown in FIG. 6, barges 96 can be used to positioned the third portion 92. Once over the top of the portions 90A and 90B, the third portion 92 can be lowered into contact with the tops of the portions 90A and 90B and the three portions can be coupled together (e.g., welded) to form the base unit 70, as shown in FIGS. 2A and 2B. In this embodiment, the base unit 70 includes the lower cross ties 22, whereas in the embodiment shown in FIG. 3, the two base units 70A and 70B can be constructed without the lower cross ties 22, and the lower cross ties 22 can optionally be added at a later time, or not at all.

Once the three portions 90A, 90B and 92 shown in FIG. 6 are joined together to form the base unit 70, the entire base unit 70 can be lowered in the water by further flooding the enclosed internal regions 94 and/or flooding enclosed internal regions in the third portion 92, such as the regions 98 shown in FIG. 6. Once the base unit 70 has been lowered to a desirable level, the separately constructed middle unit 72 can be positioned over the top of the third portion 92 and coupled (e.g., welded) to the base unit 70.

In the embodiment shown in FIGS. 3-5, the two individual base units 70A and 70B can likewise be lowered in the water by flooding internal floatation chambers, and, with the base units 70A and 70B properly spaced and aligned, the middle unit 72 can be positioned above the base units and coupled to them.

Once the middle unit 72 is coupled to the base unit 70, the structure can be further lower in the water by flooding one or more internal floatation chambers in the base unit 70 and/or the middle unit 72, and the top unit 74 can be positioned above the middle unit 72 can coupled together. The illustrated top unit 74 desirably has a positive hydrodynamic stability in an upright orientation such that it naturally floats with the top surface 62 above water, even with heavy facilities pre-coupled to the top surface.

The coupling together of the base unit 70, the middle unit 72, and the top unit 74 can be performed at any location with sufficient water depth, be it just off shore from the dry dock 80 where the units are constructed, or at a drilling site in an arctic sea. Because the GBS 10 comprises an open structure with large open regions between the base sections 12 and the inclined section 14, the entire assembled GBS 10 can be transported (towed) in water with reduced drag. The assembled GBS 10 is preferably towed in the water in the length direction L (see FIG. 1) such that two foot portions 30A or the two foot portion 30B are leading. When towed in this orientation, the base sections 12 and the inclined sections 14 have a minimal drag profile and the large open region 42 is aligned with the direction of travel, reducing hydrodynamic drag. In addition, the chamfered base sections 12 can reduce hydrodynamic drag as the GBS moves through the sea. Alternatively, the individual assembly units 70, 72, 74 can be separately towed to the set-down location and then assembled.

The overall configuration of the GBS has a very favorable hydrodynamic stability. In a desirable form, the pyramidal shape with broader, heavier base sections and narrower, lighter upper section contribute to the stability. As such, the GBS can be naturally stable in the upright position when afloat in water. In addition, the open structure of the GBS results in a reduced weight relative to a conventional GBS designed for the same water depth. The reduced overall weight, reduced drag, and natural hydrodynamic stability can make the GBS easier to transport in its fully assembled form across long distances in water, such as from near a dry dock to an arctic drilling location.

Once the assembled GBS 10 is at a desired set-down location, the entire GBS 10 can be lowered onto the seabed by further flooding internal floatation chambers with sea water until the bottom surfaces of the base sections 12 come into contact with the sea floor. The sea floor can be pre-conditioned prior to set-down, such as by leveling the surface, removing unstable material, adding material, etc. Desirably, the set-down location has a level sea floor such that the entire lower surfaces of the base sections 12 are supported by the sea floor. One advantage of the widely spaced base sections is that it reduces the overall footprint of the GBS on the seabed and thus reduces the amount of seabed preparation needed prior to set-down. In addition, the underside of the base sections 12 can be reinforced to withstand the pressures exerted by uneven seabed conditions. In some embodiments, a foundation skirt can be provided on or adjacent to the underside of the base section 12 to improve the stability of the foundations.

After the GBS is set down on the sea floor, the upper surface level of the sea is, under normal conditions, between the top of the transition section 52 and the top of the upright annular section 54, such that the upright annular section 54 protrudes through the surface of the water. Due to the relatively narrow width of the upright annular section 54, it can limit the magnitude of lateral forces imparted on the GBS 10 from wave action and from ice formations at the surface of the sea. In addition, the open structure of the base sections 12 and the inclined sections 14 can allow water currents to pass through the GBS with reduced resistance, particularly in the length direction L of the base sections 12. These features can reduce the total lateral load imparted on the GBS 10 compared to traditional GBS designs. The GBS can be oriented with the length direction oriented toward prevailing water currents to reduce lateral forces.

The widely spaced base portions 12 prevent the GBS 10 from overturning over due to lateral loads. In addition, the lateral frictional forces between the base sections 12 and the sea floor are sufficient to prevent the lateral sliding of the GBS along the sea floor. Nevertheless, in some embodiments, although less desirable, the GBS 10 can be further secured to the sea floor with piles, anchors, or other mechanisms. The GBS 10 can be configured to be used in deep waters with depths up to about 200 meters. One exemplary embodiment can be configured to be used in water depths of at least 150 meters, such as a range of water depths from about 150 meters to about 200 meters, while other exemplary embodiments can be configured to be used in other water depth ranges. The range of water depths a particular embodiment is designed for can be related to the vertical height of the upright annular portion 54.

Because the GBS is at least partially submerged in water when in use, the weight of the GBS can partially be supported by the water and partially be supported by the seabed. The portion supported by the seabed can be referred to as on-bottom weight. In the described embodiments, the two base sections 12 are configured to transfer substantially all of the on-bottom weight of the GBS to the seabed.

Figure 7A:
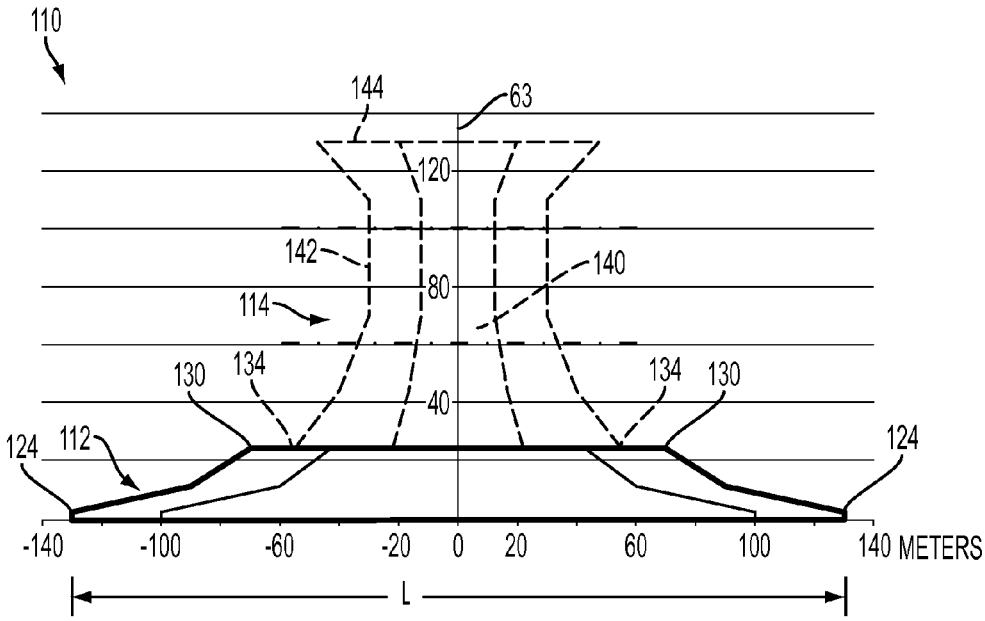
FIG. 7A is a side profile view of an exemplary gravity base structure for shallower waters.
Figure 7B:
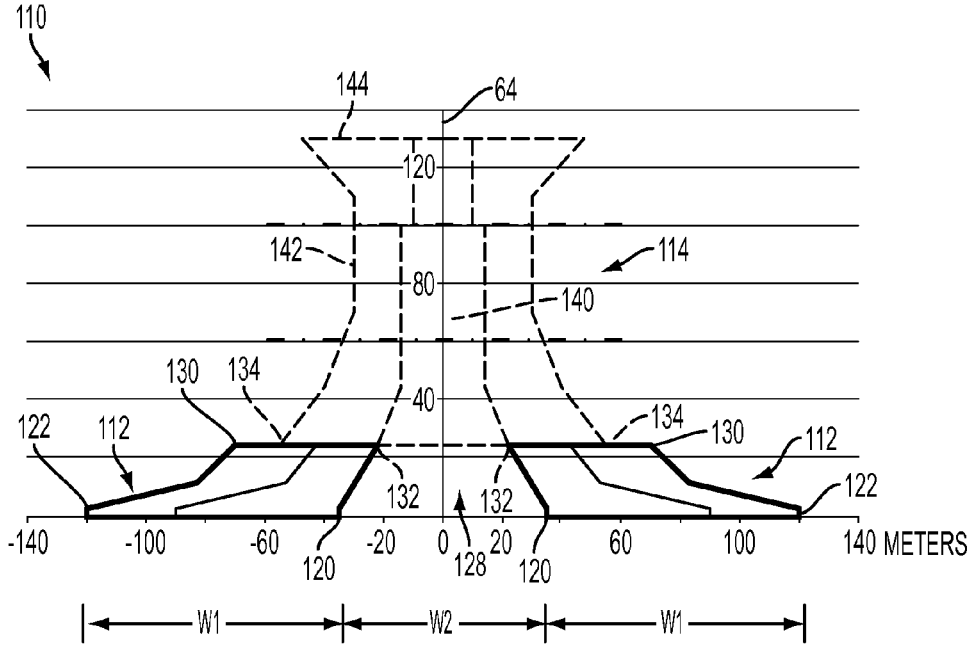
FIG. 7B is a front end profile view of the gravity base structure of FIG. 7A.
Figure 8:
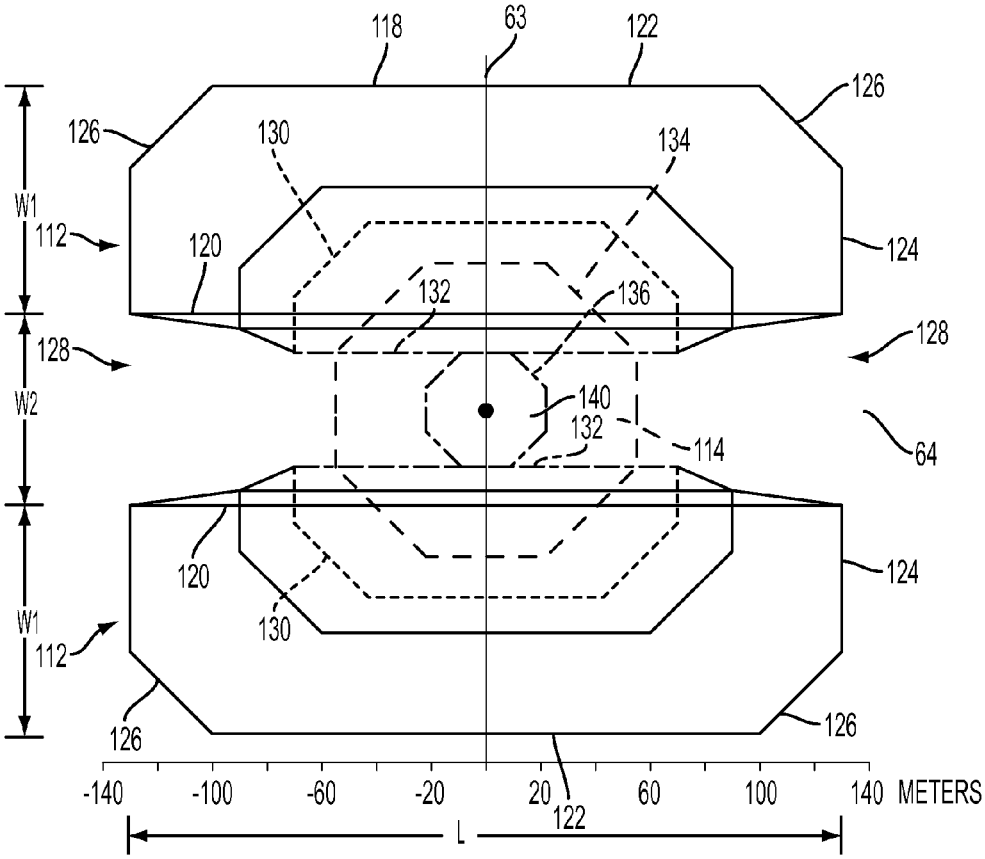
FIG. 8 is a top plan view of a lower portion of the gravity base structure of FIGS. 7A and 7B.

FIGS. 7 and 8 show another embodiment of a GBS 110 that is configured to be used in water depths down to about 60 meters. One exemplary embodiment of the GBS 110 can be configured to be used in a range of water depths from about 60 meters to about 100 meters, while other exemplary embodiments can be configured to be used in other ranges. The GBS 110 comprises two spaced apart base sections 112 and an upper section 114 extending upwardly from the base sections 112. FIGS. 7A and 7B shown cross-sectional side and end views, respectively, of the GBS 110. FIG. 8 is a partial plan view of the GBS 110 showing outlines of the two base sections 112 at different heights and a lower profile of the upper section 114.

The base sections 112 can have a generally rectangular lower footprint 118 with generally parallel inner edges 120 and outer edges 122, generally parallel end edges 124, and diagonal or chamfered outer corner edges 126. Each footprint 118 can have a longitudinal length L, which can be about 250 meters, and a width W1, which can be about 85 meters. An open region 128 between the two base sections 112 can have width W2, which can be about 70 meters, and can extend the entire length L between the base sections 112. The base sections 112 can taper (continuously or partially) to an upper perimeter 130. An inner edge 132 of the upper perimeter 130 can be inward of the inner edge 120 of the footprint 118 such that the base sections 112 slant inwardly toward each other.

The upper section 114 can comprise an upright annular body with a variable horizontal cross-sectional profile. The upper section 114 can comprises a lower outer perimeter 134, which can have an octagonal shape as shown in FIG. 8, or another shape. The outer perimeter 134 can overlap a portion of the upper surface of the base sections 112 within the upper perimeter 130 and can intersect the inner edges 132. The upper section 114 can further comprise a lower inner perimeter 136 within the lower outer perimeter 134. The lower inner perimeter 136 is positioned over the open region 128 and can share lateral edges with the inner edges 132 of the bases sections 112. The upper section 114 can define an open inner region 140 that extends axially or vertically entirely through the upper section 114 and can have a variable cross-sectional area. The upper section 114 can taper in cross-sectional area moving upwardly from the bass section 112 to a narrowest vertical portion 142 and then increase in horizontal cross-sectional area moving upwardly from the vertical portion 142 to an upper surface 144.

The GBS 110 can be constructed and assembled in a similar manner as the GBS 10. For example, the base sections can be constructed individually and the upper section can be constructed in one or two parts that are assembled at sea.

The dimensions shown in FIGS. 7 and 8 are merely exemplary and do not limit the disclosure in any way. These dimensions illustrate one exemplary embodiment, and other embodiments can have different dimensions.

The upper section 18 of the GBS 10 and the upper section 114 of the GBS 110 can comprise an inner open region through which drilling equipment passes from the upper platform to the seabed. This inner open region can be open at the upper and lower ends such that the seawater level within the open inner region naturally adjusts to the same height as the seawater surrounding the upper section. This inner region can be referred to as a "moon pool" and the surrounding upright annular structure can be referred to as a "caisson." In addition to structurally supporting the topside structures, the caisson can isolate the drilling equipment from waves and ice formations at the surface of the sea. Such ice formations extend several meters below sea level and thus the caisson desirably extends at least this far below sea level in a desirable embodiment.

The structural components of the GBS embodiments disclosed herein can comprise any sufficiently strong, rigid material or materials, such as steel. In some embodiments, any of the lower components of the GBS, such as the base sections 12, can comprise concrete.

In some of the embodiments described herein, the first base section can comprise a first point at one end and a second point at the opposite end, the second base section can comprise a third point at one end and a fourth point at the opposite end, and the first, second, third, and fourth points define the vertices of a horizontal quadrilateral area, such that all portions of the GBS with greater elevation than the quadrilateral area are positioned directly above the quadrilateral area. For example, in the embodiment 10 of FIG. 1, the entire first and second inclined sections, the entire transition section, and the entire upper section and topsides are positioned directly above an area defined by the four foot portions 30.

The GBS embodiments disclosed herein can be used for various purposes. Some embodiments can be used for exploratory drilling wherein the GBS is moved to various locations to explore for desirable condition. Such embodiments can be configured to support exploratory drilling structures and equipment on the topsides. Other embodiments can be used in more permanent hydrocarbon production operations, wherein the GBS may stay at one location for a long period of time, such as several years, while hydrocarbons are extracted and processed. Some embodiments can be used for both exploratory purposes and production purposes. For exploratory operations, it can be desirable for the GBS to be functional in as great a range of water depths as possible. Accordingly, it can be desirable for the caisson portions to have a longer vertical height, while maintaining structural stability, such that the GBS can be used in a greater range of water depths. When used as a substructure for a permanent production facility, which can weigh up to 120,000 tonnes, the GBS can have a broader, more robust upper portion as production facilities are typically much larger and heavier than exploratory drilling rigs. In any case, the upright annular section, or caisson, can be configured to support substantially all of the weight of whatever hydrocarbon extraction superstructure is positioned on top of the upright annular section.

The illustrated embodiments can be used on seabeds with cohesive soils having an undrained shear strength lower than 30 kPa and larger embodiments (such as in FIG. 1 with lower and upper cross ties 22, 24) can withstand multi-year ice loads greater than 660 MN. Some of these larger embodiments can have an overall weight of less than 280,000 tonnes, not including the topside structures, due to the open structure.

In some of the embodiments described herein, any one or more of the various components of the GBS can comprise internal chambers that can be used to temporarily or permanently store fluids, such as water, hydrocarbons, air, and mixtures of such fluids. Desirably, all or most of the major structural components can comprise internal chambers that can be selectively filled with and/or emptied of fluid ballast to sink or raise that component and/or assemblies comprising that component. In some embodiments, internal chambers used for storing hydrocarbons can comprise double-skinned walls to reduce the risk of spills. Furthermore, any of the internal chambers of the GBS can comprise solid ballast.

In preferred embodiments, certain internal chambers are dedicated for storing hydrocarbons while other internal chambers, i.e., floatation chambers, are dedicated for storing seawater, such that hydrocarbons are not mixed with seawater. This can be referred to and "dry" hydrocarbon storage. In such embodiments, the chambers that are filled with seawater are designed to remain filled with seawater while the GBS is positioned at a seabed location, in order to maintain sufficient gravitational interaction with the seabed, and the seawater is only removed in order to lift and move the GBS to another location. In these embodiments, the chambers for storing hydrocarbons can be selectively filled and emptied as desired while the GBS is at a seabed location, and when they are not full of hydrocarbons, air or another gas can be used to fill them. In this way, the hydrocarbons do not mix with seawater. These embodiments can maintain sufficient overall density even when the hydrocarbon chambers are filled with air or other gasses. In some of these embodiments, the internal chambers can comprise from about 150,000 bbl to about 250,000 bbl of dry hydrocarbon storage. Typically, such dry hydrocarbon storage chambers can be located in the upper portions of the GBS, such as the caisson section 18, the transition section 16, and the upper portions of the strut sections 14, while dedicated seawater storage chambers can be in located lower portions of the GBS.

In other embodiments, the same chambers can be used to store both seawater and hydrocarbons in a variable proportion such that the chambers are always filled with seawater and/or hydrocarbons. As hydrocarbons are added to the chambers, portions of the seawater in the chambers can be released into the sea, and as hydrocarbons are removed from the chambers, seawater can be added to the chambers. In these embodiments, the hydrocarbons can mix with the seawater, requiring that any seawater removed from the chambers can need to be cleaned prior to being released to the sea. Such embodiments can be made smaller and/or with less volume of internal chambers since all of the chambers are always full of a liquid, whereas embodiments with dedicated seawater and hydrocarbon chambers require a greater total chamber volume because they are filled with air or other gas when emptied of fluid and additional ballast is needed to compensate for the additional buoyancy.

FIGS. 9-12 illustrate an exemplary process for raising an embodiment of the GBS 10 off the seabed such that it can be relocated, sinking the GBS, or adjusting the floating level of the GBS, such as during towing. Some embodiments of the GBS 10 can comprise a plurality of internal watertight subdivisions, or chambers, that can be selectively filled with liquid and emptied to adjust the weight of the GBS. The chambers (as well as chambers in the foot portions and cross members/cross ties) can be sealed against water leakage therebetween. Alternatively, selected chambers can have passageways therebetween so that they are emptied and filled together. This also does not preclude the GBS 10 comprising some chambers that are always filled with fluid during normal use and towing. The number, size and arrangement of such chambers can vary, and the exemplary embodiment shown in FIGS. 9-12 is just one possible example.

Figure 9:
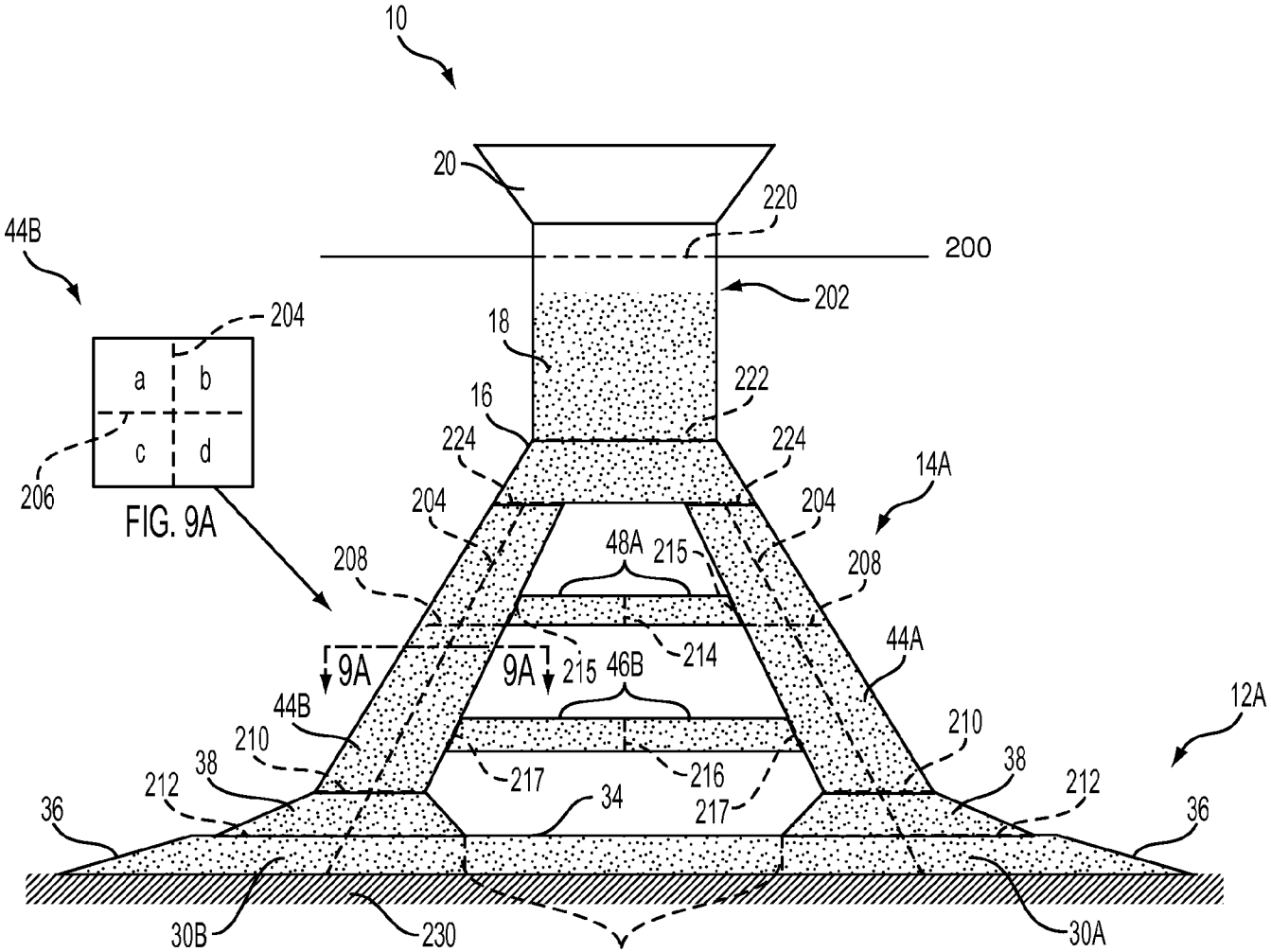
FIG. 9 is a side profile view of an exemplary embodiment of a gravity base structure having a plurality of internal watertight chambers and resting on a sea floor.
Figure 10:
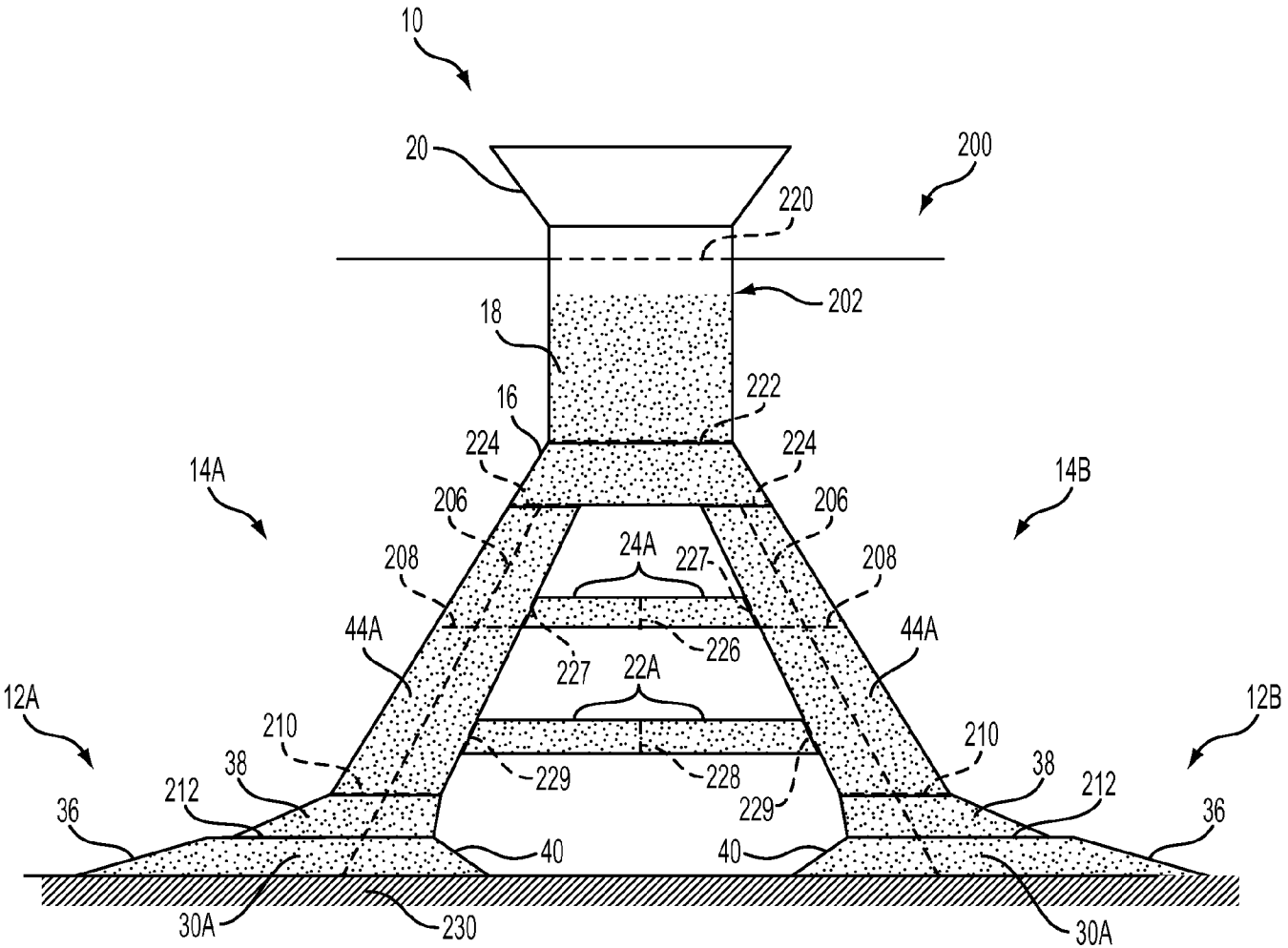
FIG. 10 is an end profile view of the embodiment of FIG. 9.

In the exemplary GBS 10 shown in FIGS. 9 and 10, each of the inclined struts 44A and 44B are subdivided into a plurality of chambers. Each strut 44 can comprise one or more longitudinally extending and uprightly extending dividers and one or more transversely extending dividers such as horizontal dividers. For example, each strut 44 can be divided into longitudinal quarters by orthogonal dividers 204 and 206 (as shown in FIG. 9A) that extend along the entire length of the struts. Each strut 44 can further be divided transversely by dividers 208, forming eight chambers in each strut 44 in this example. In the illustrated example, some of the chambers are oriented in a side-by-side orientation. Also, some chambers are stacked end to end in the struts.

The chambers at lower ends of the struts 44 can be separated from chambers in foot portions 30, such as by horizontal dividers 210. Each foot 30 can also be subdivided into plural chambers or subdivisions. For example, the upper portions of each foot can be separated from the lower portions 36 by another divider 212. Furthermore, the longitudinal dividers 204, 206 can extend through the foot portions 30 to the bottom of the GBS, dividing each foot portion into plural chambers, such as four quadrants each having an upper chamber and a lower chamber divided by the divider 212.

The upper portions 16 and 18 of the GBS 10 can also comprise fluid chambers. The caisson section 18 can comprise an upper transverse or horizontal divider 220 and can be separated from the transition section 16 by a transverse or horizontal divider 222. The transition section can be separated from the upper ends of the struts 44 by transverse or horizontal dividers 224. Any of the transverse dividers can alternatively be non-horizontal in some embodiments, and need not be planar, although planar dividers is one desirable form.

The cross members 46 and 48 that connect the struts 44A and 44B can be subdivided into plural fluid chambers. In the example shown in FIG. 9, the upper cross members 48 comprise a middle divider 214 that separates the cross member into two end to end chambers and end dividers 215 that separate the two chambers of the cross member 48 from the chambers of the struts 44. The lower cross members 46 can also comprise plural chambers, such as defined by a central or intermediately positioned or middle divider 216 that separates the cross member into two end-to-end chambers and end dividers 217 that separate the two chambers of the cross member 46 from the chambers of the struts 44.

Similarly, the cross ties 22 and 24 can also be subdivided into plural fluid chambers. In the example shown in FIG. 10, the upper cross ties 24 comprise a central or intermediately positioned or middle divider 226 that separates the cross tie into two chambers and end dividers 227 that separate the two chambers of the cross tie 24 from the chambers of the struts 44. The lower cross tie 22 can comprise divider 228 that separates the cross tie into two end-to-end chambers and end dividers 229 that separate the two chambers of the cross tie 22 from the chambers of the struts 44.

Each of the foot portions 30A and 30B can also be separated from the intermediate portion 34 of the base section 12 by respective dividers 218, as shown in FIG. 9.

FIGS. 9 and 10 show the subdivided GBS 10 resting on the seabed 230 with the sea level 200 nearly even with the upper divider 220 of the caisson portion 18. This can be the maximum operating water depth of the GBS during normal operating conditions. To keep the GBS 10 resting on the seabed 230, a sufficient percentage of the GBS is filled with seawater and/or hydrocarbons to overcome the buoyancy of the GBS. In the illustrated example, all of the internal chambers of the GBS are filled with seawater up to a filling level 202, which is spaced below the sea level 200. In this configuration, the gravitational forces on the GBS overcome the buoyant forces and the GBS remains held in place on the seabed.

Figure 11:
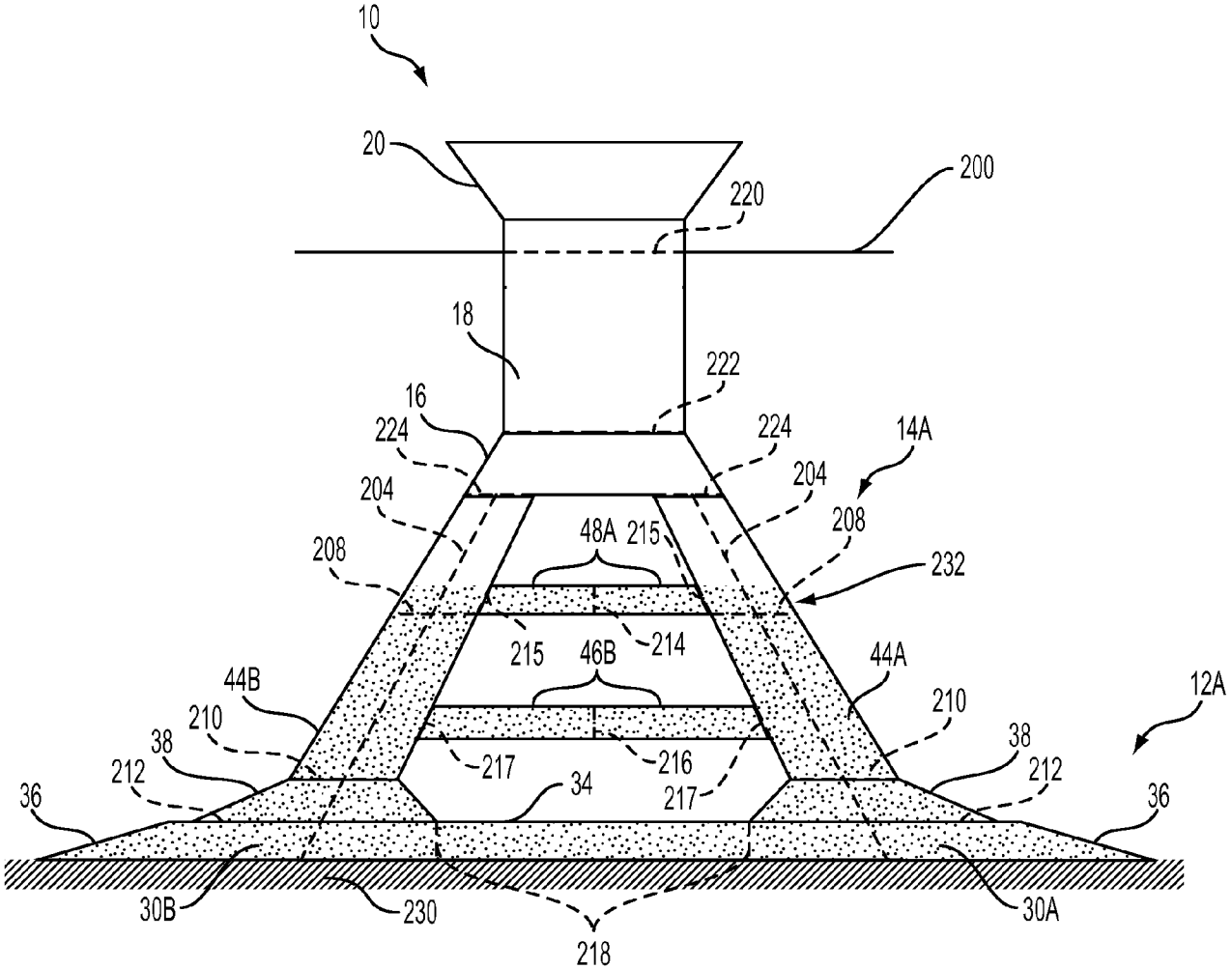
FIG. 11 is a side profile view of the embodiment of FIG. 9, in an exemplary state being partly filled with water and configured for either set-down on the sea floor or lift-off from the sea floor.

FIG. 11 shows the GBS with a lower volume of seawater stored in the internal chambers than shown in FIGS. 9 and 10. The internal water level 232 is at about the level of the top of the upper cross members 48. The caisson section 18 and transition section 16 are emptied of seawater and desirably filled with air. In addition, some of the upper chambers of the struts 44 are partially filled with seawater and partially filled with air. All of the chambers below the filling level 232 are completely or at least substantially filled with water. At about this filling level, the buoyant forces of the GBS are approximately even with the gravitational forces. In other embodiments, the filling level 232 corresponding to an approximately even buoyancy-gravity balance can be higher or lower than shown in FIG. 11, depending the configuration and material of the GBS. It should be noted that different chambers other than those shown in FIG. 11 can be emptied of seawater to achieve the desired GBS gravity-buoyancy balance. For example, some or all of the lower chambers of the struts and feet can be emptied while higher chambers remain filled.

With a neutral buoyancy-gravity balance, the GBS can be carefully raised from the seabed or lowered toward the seabed. If the buoyancy of the GBS is too much greater than the gravity, the GBS can tend to rise too rapidly, which can cause damage to the GBS and other undesirable consequences. Similarly, if the gravity is too much greater than the buoyancy, the GBS can sink too rapidly, which can cause damage to the GBS and other undesirable consequences.

It can be desirable to keep the center of gravity of the GBS as low as possible to prevent tipping. Thus, it can be desirable to empty the seawater from the GBS starting from the uppermost chambers and moving downward. Similarly, it can be desirably to fill the lowermost chambers first and gradually fill the chambers moving upward. This concept is illustrated in FIGS. 9-12. In other embodiments, however, seawater can be added or removed from the chambers in other sequences or patterns, such as gradually from all of the chambers simultaneously. Alternative filling and emptying patterns or sequences can provide other advantages with regard to force and stress distributions, moment of inertia control, etc.

Figure 12:
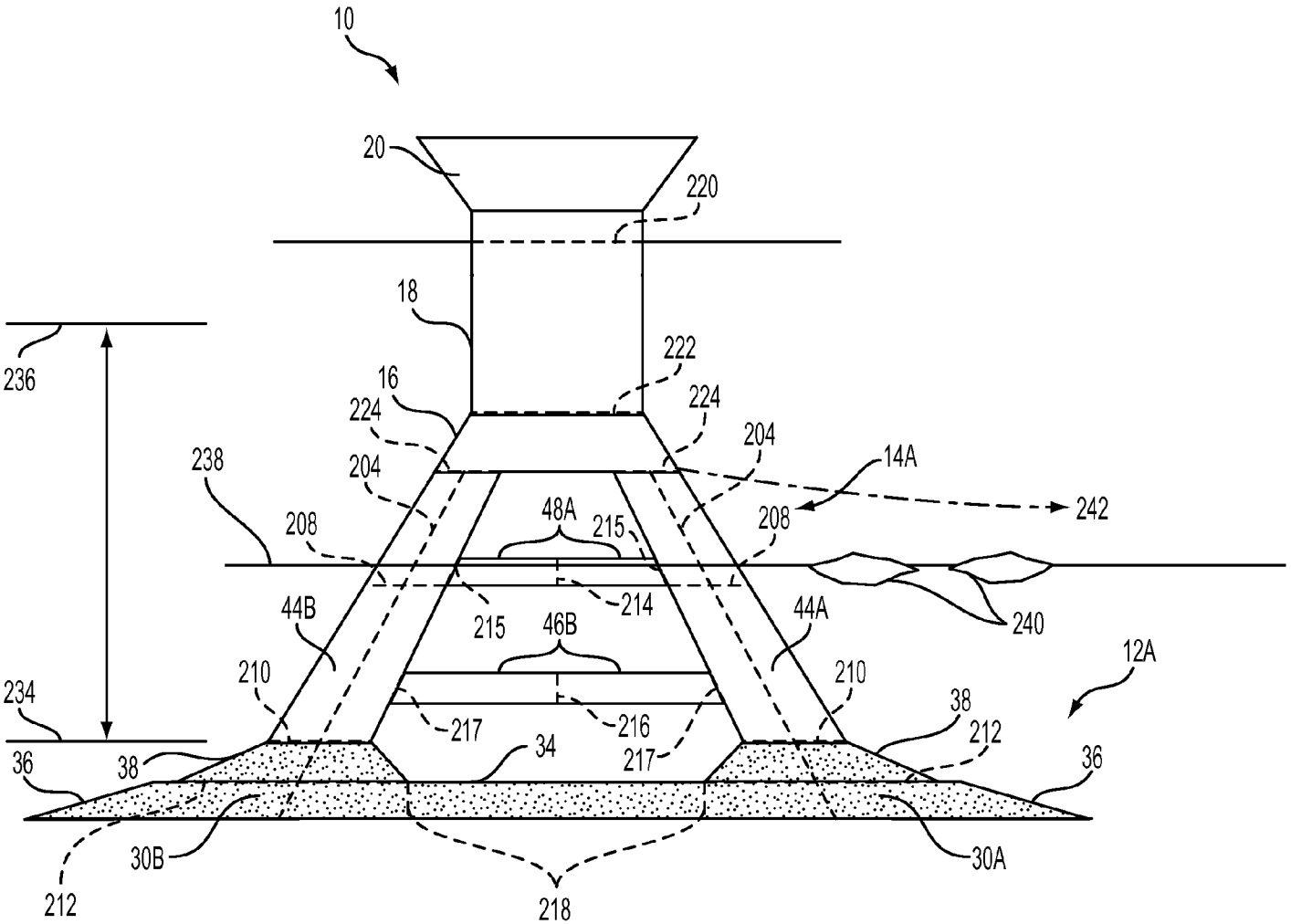
FIG. 12 is a side profile view of the embodiment of FIG. 9, in an exemplary state being mostly empty of water and floating above the sea floor.

FIG. 12 shows the GBS 10 with all of the fluid chambers above the base sections 12 empty and shows the GBS 10 floating with the sea level 238 at about the level of the upper cross members 48. In this configuration, the GBS 10 can be towed through the sea, such as to relocate the GBS to a new drilling location where the GBS can be set down on the seabed by filling the internal chambers with seawater. The horizontal lines 234 and 236 represent exemplary lower and upper boundaries, respectively, of a range of possible draft levels for towing the GBS through the sea. For example, the lower level 234 can correspond to a state where all or nearly all of the internal chambers are empty or nearly empty of fluid such that the GBS floats very high in the sea with the sea level about even with the tops of the base sections 12, while still remaining sufficiently stable. Conversely, the upper level 236 can correspond to a state where a maximum volume of fluid is stored in the internal chambers and the sea level is about even with the caisson section 18, while still remaining buoyant. The liquid level in the various chambers can be varied as the GBS is being towed. For example, if seas and wind are calm, the GBS can be floated higher in the water column to reduce towing drag. In contrast, if winds are high and/or waves are rough, the GBS can be floated lower in the water column to increase its stability during towing. In heavy ice conditions, the GBS is can also be floated lower such that the narrower and rounded caisson section passes through the ice.

The draft level of the GBS 10 can thus be adjusted to suit particular conditions while maintaining hydrodynamic and hydrostatic stability. As another example, to traverse shallower waters, the GBS can be floated higher in the sea by storing less fluid in the internal chambers, and to traverse deeper waters and/or waters with greater ice formations on the surface (such as exemplary ice formations 240 shown in FIG. 12), the GBS can be floated lower in the sea by storing more fluid in the internal chambers. The dashed line 242 shows an exemplary tow line connected to the GBS and connected with a tug boat or other towing vessel. The connection location of the towlines can be selected such that tow forces are aligned near the center of gravity or other central location of the GBS to avoid excessive tipping or rotation of the GBS and to avoid damage to the GBS.

Regardless of the draft level, the towing force must overcome the resistance of any current, wind, sea ice and other environmental effects. Due to the rounded caisson section 18, open strut sections 14, and spaced apart base sections 12, these forces on the GBS can be substantially reduced at any draft level. Furthermore, ice formations at the surface can be broken up by other vessels before the towed GBS arrives to further reduce towing resistance.

Figure 13:
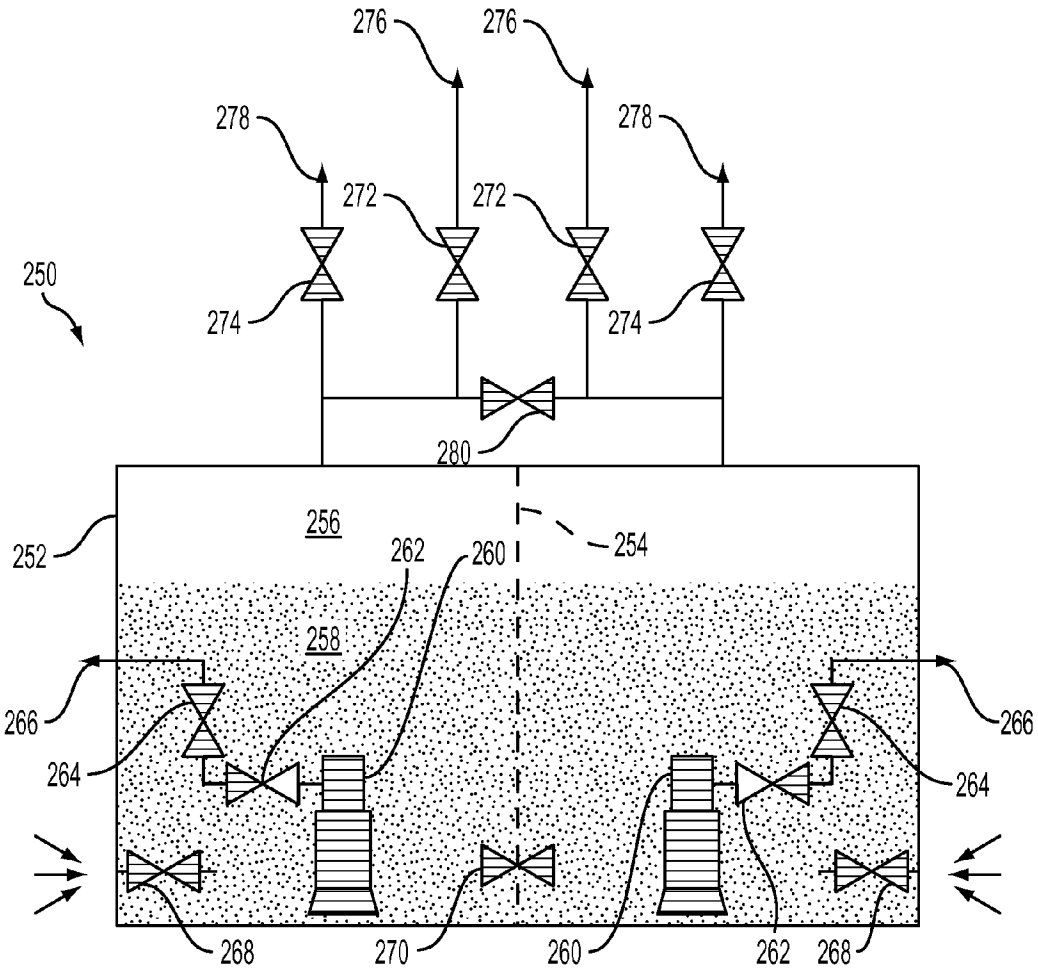
FIG.13 is a diagram showing an exemplary seawater filling and discharge system for the embodiment of FIG. 9.

FIG. 13 is a diagram of an exemplary system 250 for adjusting the fluid and gas levels within exemplary chambers of the GBS. Two chambers are shown having an outer wall 252 and a divider 254 that separates the two chambers and that seals the two chambers from one another and from the environment. Each of the chambers can be partially filled with fluid 258 (e.g., seawater or hydrocarbons) and partially filled with gas 256 (e.g., air). Each chamber can comprise a fluid pump 260 located near the bottom of the chamber and coupled to one or more valves (e.g., a non-return or one-way valve 262 and a discharge valve 264) configured to expel the liquid 258 out of the chamber at outlet 266, such as into the sea or into another chamber. Each chamber can also have a seawater inlet valve 268 to admit seawater into the chamber, such as from the sea or from another chamber. The pump 260 and the inlet valve 268 can be operated together to control the volume of liquid in the chamber. A valve 270 can connect adjacent chambers to allow liquid the move between them, such as to ensure adjacent chambers maintain an even liquid level. One or more vents or outlet valves 272 can be coupled to the top of the chambers to allow gas to exit the chambers via outlets 276, such as to the atmosphere to another chamber. One or more gas inlet valves 274 can also be couple to the top of the chambers to admit gas into the chambers, such as from a compressed air source or from another chamber. An additional valve 280 can couple to gas conduits from adjacent chambers to ensure even gas pressure distribution between the chambers.

Desirably, the valves are remotely controlled valves. For example, they can each be electrically connected to a controller and responsive to a control signal generated in response to signals from the controller to pend and/or close the valve. The valves can also be controllable in response to manually (e.g. switch activations) generated control signals. The controls can be programmed to establish the desired sequence of valve activation to fill or empty the chambers to float or sink the GBS.

Plural chambers can be in fluid communication with one another such that a single valve can fill or empty the chambers together. A valve can separate these chambers to selectively allow fluid communication between them so that they are not filled or emptied together.

In other embodiments, the GBS can comprise one or more centralize pumping systems that remote replace the function of the localized pumps 260 in each chamber. Such a centralized pumping system can have one or more pumps located in a centralized part of the GBS and can be coupled to each chamber via piping. Similarly, the compressed gas source can be centralize and coupled to each chamber via piping. This can provide more useable volume in each chamber and reduce the total weight and cost of the gas and liquid pumping systems.

Some embodiment of the GBS can also comprise a system of piping and mechanical equipment that is configured to introduce and/or extract water or air at the underside of the GBS base sections 12 to assist in establishing contact with or separation from the seabed. Such a system can assist in creating an even distribution of contact forces across the underside of the base sections 12 during set-down of the structure by locally disturbing the stability of the seabed surface material. The same or similar system can also be used to assist in the release of the structure prior to floatation by loosening compacted soil, breaking suction, and/or pressurizing the area between the base sections 12 and the seabed. Such conditions may be encountered if the structure is placed on relatively soft cohesive soils, particularly of the structure is fitted with a skirt arrangement beneath the base sections 12, as is shown in the exemplary embodiment of FIGS. 14 and 15.

Figure 14:
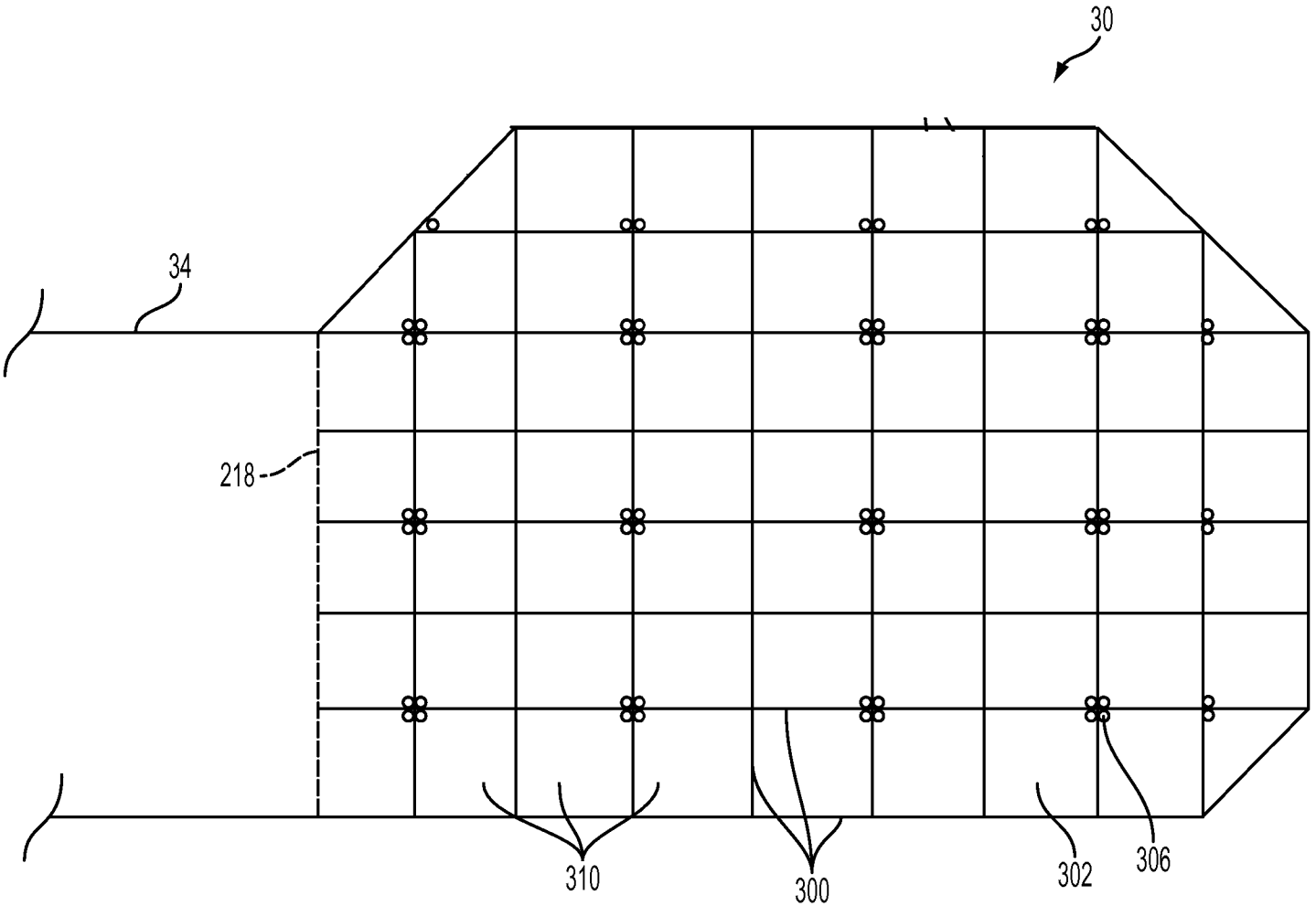
FIG. 14 is a bottom view of a foot portion of the embodiment of FIG. 9, showing an exemplary skirt configuration and exemplary locations of fluid outlets for increasing and decreasing fluid pressure beneath the gravity base structure.
Figure 15:
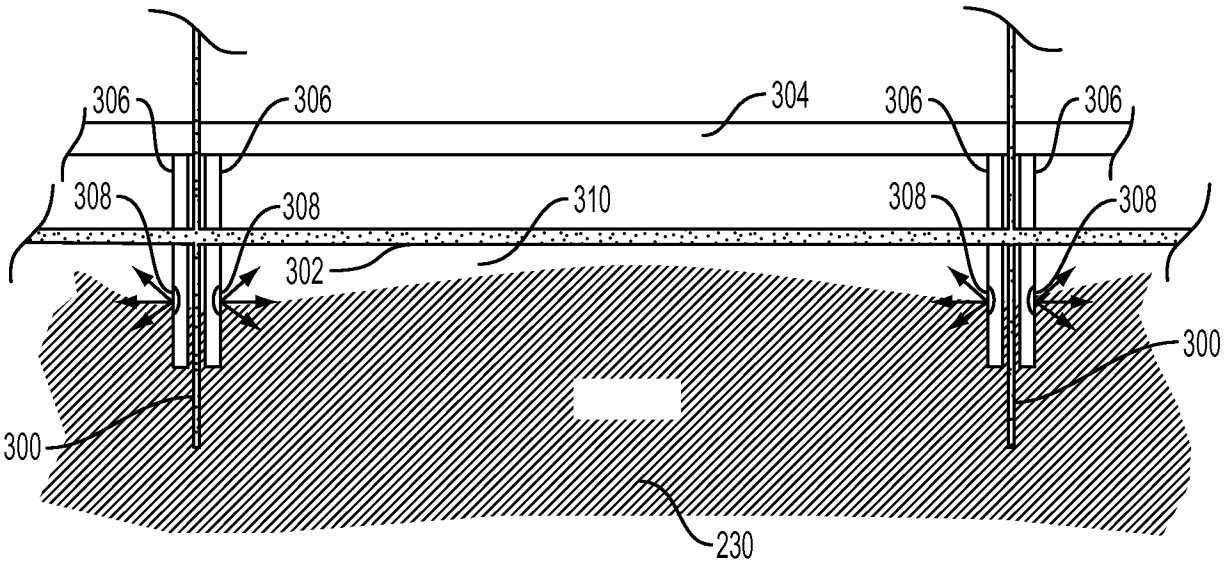
FIG. 15 is a schematic cross-sectional side view of the foot portion of FIG. 14 showing an exemplary arrangement of the skirt and fluid outlets in relation to the bottom of the gravity base structure and the seabed.

FIG. 14 is a bottom view of a portion of one base section 12 showing a skirt structure 300 attached to the underside of the foot portions 30. FIG. 15 shows a cross-sectional side view showing the skirt structure 300 engaged with the seabed. The skirt structure can define a plurality of chambers or cells (a few being numbered 310 in FIG. 14) that open downwardly in this example. In one specific example, the underside of the base sections 12 can comprise transverse body members such as horizontal base plates 302 that can also form bottom walls of one or more fluid chambers within the GBS. The skirt structure 300 can comprise a plurality of projections, such as upright walls, that extend downwardly from the base sections 12. The projections can form a grid pattern of intersecting plates that defines a plurality of open chambers 310 on the underside of the GBS 10, as shown in FIG. 14. In some embodiments, the intersecting walls can be orthogonal to one another and form plural rectangular or square compartments. In other embodiments the walls can form triangular compartments or other shaped compartments. When the GBS 10 is in place on a seabed 230, as shown in FIG. 15, the skirt structure 300 can embed into the soil and enclose the chambers 310 between the soil, the skirt structure 300, and the lower surface of the base section 12.

The GBS 10 can further comprise a piping system, such as is shown in FIG. 15, that includes main pipes 304 positioned in this example above the base plate 302 and within the base portions 12. The main pipes can be coupled to water and/or air pumps and downwardly extending branch pipes 306 that extend from the main pipes 304, through the base plate 302, and into the compartments 310. In some embodiments, at least one branch pipe 306 can extend into each of the compartments 310 (as shown in FIG. 14), and in some embodiments, two or more branch pipes can extend into each compartment 310 (as shown in FIG. 15). The branch pipes 306 can comprise one or more outlets 308, such as nozzles, that can be positioned below the base plate 302. One or more of the outlets 308 can be positioned below the soil level and/or one or more outlets 308 can be positioned above the soil level. Seawater and/or air can be conducted through the outlets 308, branch pipes 306, and main pipes 306 to disturb the soil 230 and/or to manipulate the pressure in the compartments 310 between the soil 230 and the base plate 302. The main pipes 304 can be configured in a loop or ring configuration for coupling plural branch pipes together.

In one example, as shown in FIG. 14, the branch pipes 306 can be clustered at adjacent corners of the compartments 310, such that the piping systems are simplified within the base structures 12. In other embodiments, the branch pipes 306 can be arranged in other manners.

Prior to lift-off of the GBS 10 from the seabed, air and/or water can be expelled from the outlets 308 to help release the skirt structure 300 and base sections 12 from the seabed 230. Pressurized air and/or water can break the soil apart and help detach chunks of the soil that remain attached to the skirt structure during lift-off. Furthermore, the expelled air and/or water can increase the pressure in the compartments 310 to help break suction with the seabed and reduce friction between the skirt structure and the soil during lift-off.

During set-down of the GBS 10 onto the seabed, air and/or water can also be expelled from the outlets 308 to pre-condition the seabed, such as by leveling the soil and/or loosening the soil so the skirt structure 300 can more easily embed into or rest upon the seabed. In addition, during set-down, water can be extracted from the compartments 310 through the outlets/inlets 308. Extracted water can be stored inside chambers of the GBS and/or can be expelled to other parts of the sea. Extracting water from the compartments 310 during set-down can reduce potential high-pressure build up in the compartments as the skirt structure 300 sinks into the seabed and the volume of the compartments decreases. In some embodiments, different openings 308 can be used for extraction versus expulsion. Different down pipe structures can also be used.

General Considerations

For purposes of this description, certain aspects, advantages, and novel features of the embodiments of this disclosure are described herein. The disclosed apparatuses, systems, and methods should not be construed as limiting in any way. Instead, the present disclosure is directed toward all novel and nonobvious features and aspects of the various disclosed embodiments, alone and in various combinations and sub-combinations with one another. The disclosed embodiments are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like “determine” and “provide” to describe the disclosed methods. These terms are high-level abstractions of the actual operations that are performed. The actual operations that correspond to these terms may vary depending on the particular implementation and are readily discernible by one of ordinary skill in the art.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means mechanically, chemically, magnetically or otherwise physically coupled or linked and does not exclude the presence of intermediate elements between the coupled items, unless otherwise described herein.

In view of the many possible embodiments to which the principles of the disclosed invention may be applied, it should be recognized that the illustrated embodiments are only desirable examples and should not be taken as limiting the scope of the disclosure. Rather, the scope of the disclosure is defined by the following claims. We therefore claim as our invention all that comes within the scope of these claims.

I claim:

1. A gravity base structure comprising:

a first elongated base section comprising inner and outer sidewall portions, first and second end portions, an upper surface, and a lower surface;

a second elongated base section comprising inner and outer sidewall portions, first and second end portions, an upper surface, and a lower surface, the first and second base sections being separated by an open region between the inner sidewall portions of the first and second base sections, the open region extending the entire length of the first and second base sections;

a strut section that bridges the first and second base sections together above the open region;

a skirt structure coupled to the lower surface of the first base section, the skirt structure comprising a plurality of projections extending downwardly from the lower surface of the first base section, the projections forming a plurality of compartments beneath the lower surface of the first base section and between the projections, the compartments being open facing downwardly, wherein the skirt structure is configured to be at least partially embedded in a seabed when the structure is positioned on the seabed; and a piping system comprising at least one down pipe for a majority of the compartments, the down pipes extending from within the first base section, through the lower surface of the first base section, and into a respective compartment, the piping system being configured to conduct fluid to or from the compartments to assist in set-down of the gravity base structure on a seabed or lift-off of the gravity base structure from a seabed;

wherein the first base section comprises first and second foot portions at opposite ends of the first base section and an intermediate portion extending between the first and second foot portions, and wherein the skirt structure extends across the first and second foot portions but not the intermediate portion.

2. The gravity base structure of claim 1, wherein the strut section comprises a first inclined strut section coupled to the first base section and a second inclined strut section coupled to the second base section, wherein at least portions of the first and second inclined strut sections converge toward each other moving upwardly from the base sections.

3. The gravity base structure of claim 1, wherein the piping system comprises at least two down pipes for at least some of the compartments.

4. The gravity base structure of claim 1, wherein at least some of the projections comprise substantially vertical walls that intersect each other at substantially right angles and at least some of the compartments are substantially cuboid.

5. The gravity base structure of claim 1, wherein the gravity base structure comprises a plurality of internal fluid storage chambers, the chambers being selectively fillable with fluid and drainable of fluid for raising or lowering the gravity base structure in a sea, and wherein the piping system is configured to transfer fluid between at least one of the chambers and at least one of the compartments.

6. The gravity base structure of claim 1, wherein the at least one down pipe comprises a plurality of downpipes and at least some of the plurality of down pipes comprise lower end portions that are configured to be embedded in the seabed when the gravity base structure is resting on the seabed.

7. The gravity base structure of claim 6, wherein the at least some of the plurality of down pipes further comprise a lower outlet in the lower end portion configured to expel fluid into the seabed to disrupt the seabed.

8. The gravity base structure of claim 1, wherein the at least one down pipe comprises a plurality of downpipes and at least some of the plurality of down pipes comprise an opening below the lower surface of the base section the opening being configured to be positioned above the seabed when the gravity base structure is resting on the seabed.

9. The gravity base structure of claim 8, wherein the opening is configured to expel fluid into or extract fluid from the respective compartment between the seabed and the lower surface of the base section.

10. The gravity base structure of claim 5, wherein at least some of the internal storage chambers comprise a liquid pump positioned within the chamber and configured to discharge liquid from the chamber and a liquid inlet valve configured to admit liquid into the chamber.

11. The gravity base structure of claim 10, further comprising a compressed gas source fluidly coupled to the chambers for transferring gas into the chambers and a gas vent fluidly coupled to the chambers for permitting gas within the chamber to be expelled.

12. The gravity base structure of claim 1, wherein the lower surface of the first elongated base section comprises a substantially horizontal bottom wall, and wherein the down pipes extend vertically down from within the first base section, through the substantially horizontal bottom wall of the first base section, and into a respective one of the compartments below the horizontal bottom wall of the first base section.

13. A gravity base structure comprising:

a first elongated base section comprising inner and outer sidewall portions, first and second end portions, an upper surface, and a lower surface configured to be supported by a floor of a body of water;

a second elongated base section comprising inner and outer sidewall portions, first and second end portions, an upper surface, and a lower surface configured to be supported by the floor of the body of water, the first and second base sections being separated by an open region between the inner sidewall portions of the first and second base sections, the open region extending the entire length of the first and second base sections, the first and second base sections being configured to transfer substantially all of the on-bottom weight of the structure to the floor when the gravity base structure is supported by the floor;

an upright annular section positioned above the open region and configured to extend at least partially above an upper surface of the body of water, the upright annular section comprising an upwardly extending opening through the upright annular section;

a first inclined section coupled to the first base section and coupled to the upright annular section; and a second inclined section coupled to the second base section and coupled to the upright annular section;

wherein at least portions of the first and second inclined sections converge toward each other moving from the base sections toward the upright annular section; and wherein the first and second base sections each comprise a plurality of internal fluid storage chambers, and the first and second inclined sections each comprise a plurality of internal fluid storage chambers, each of the internal fluid storage chambers being selectively fillable with seawater and drainable of seawater to raise or lower the gravity base structure in a sea.

14. The gravity base structure of claim 13, wherein:

at least one of the first and second base sections comprises two opposing foot portions and an intermediate portion connecting the opposing foot portions, the intermediate portion being narrower than the opposing foot portions;

and the gravity base structure further comprises:

a skirt structure coupled to a lower surface of one of the opposing foot portions, the skirt structure comprising a plurality of skirt walls extending downwardly from the lower surface of the foot portion, the skirt walls intersecting one another to form a plurality of substantially rectangular open compartments beneath the lower surface of the base section and between the skirt walls, the open compartments having an open bottom side configured to receive seabed material into the compartments, wherein the skirt structure is configured to be at least partially embedded in a seabed when the gravity base structure is positioned on the seabed; and a piping system comprising at least one down pipe for a majority of the compartments, the down pipes extending from within the at least one opposing foot portion, through the lower surface of the foot portion, and into a respective compartment, the piping system being configured to conduct fluid to or from the compartments to assist in set-down of the gravity base structure on the seabed or lift-off of the gravity base structure from the seabed.

15. The gravity base structure of claim 14, wherein the structure is at least 200 meters tall.

16. The gravity base structure of claim 14, wherein each of the first and second base sections comprises two opposing foot portions and an intermediate portion connecting the opposing foot portions, the intermediate portion being narrower than the opposing foot portions, the gravity base structure comprises one of said skirt structures coupled to each of the foot portions of both of the base sections, and the piping system is coupled to each of the skirt structures.

17. The gravity base structure of claim 14, wherein the piping system comprises clusters of four down pipes, and for each cluster of down pipes, each of the four down pipes are positioned in different respective corners formed by an intersection between two substantially perpendicular skirt walls, each of the different respective corners being in a different compartment.

18. The gravity base structure of claim 13, wherein first and second inclined sections comprise inclined struts coupled together with horizontal tie members, and wherein each inclined strut comprises an upper portion that comprises at least two fluid storage chambers and a lower portion that comprises at least two of said fluid storage chambers.

19. The gravity base structure of claim 13, wherein the first and second end portions of the first base section and the first and second end portions of the second base section each comprises an upper portion that comprises at least two fluid storage chambers and a lower portion that comprises at least two fluid storage chambers.

20. The gravity base structure of claim 13, further comprising:

a skirt structure coupled to the lower surface of the first base section, the skirt structure comprising a plurality of projections extending downwardly from the lower surface of the first base section, the projections forming a plurality of compartments beneath the lower surface of the first base section and between the projections, the compartments being open facing downwardly, wherein the skirt structure is configured to be at least partially embedded in a seabed when the gravity base structure is positioned on the seabed; and a piping system comprising at least one down pipe for a majority of the compartments, the down pipes extending from within the first base section, through the lower surface of the first base section, and into a respective compartment, the piping system being configured to conduct fluid to or from the compartments to assist in set-down of the gravity base structure on a seabed or lift-off of the gravity base structure from a seabed.

* * * * *